US012209468B1

(12) United States Patent
Rolovic

(10) Patent No.: US 12,209,468 B1
(45) Date of Patent: Jan. 28, 2025

(54) COILED TUBING REEL HAVING A COILED TUBING EXIT OPENING EXTENDING THROUGH A SIDEWALL THICKNESS (t) OF THE FLANGE

(71) Applicant: Halliburton Energy Services, Inc., Houston, TX (US)

(72) Inventor: Radovan Rolovic, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/399,361

(22) Filed: Dec. 28, 2023

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 4,003,435 A * 1/1977 Cullen ..... B65H 51/04 166/77.2
4,945,938 A * 8/1990 Ponsford ..... B60P 3/035 137/15.01
5,211,203 A * 5/1993 Vollweiler ..... B65H 75/4402 137/355.21
5,598,866 A * 2/1997 Nelson ..... B65H 75/425 137/355.27
6,276,454 B1 8/2001 Fontana et al.
6,533,216 B1 3/2003 Bumgarner et al.
2004/0232273 A1 11/2004 Arai et al.
2006/0011775 A1 1/2006 Arai et al.
2006/0049298 A1 3/2006 Arai et al.
2018/0112473 A1 4/2018 Howell, Sr. et al.
2023/0349246 A1* 11/2023 Yoder ..... B65H 75/4478

FOREIGN PATENT DOCUMENTS

JP 2007185432 A 7/2007
KR 20090088970 8/2009

* cited by examiner

*Primary Examiner* — Matthew R Buck
(74) *Attorney, Agent, or Firm* — Thomas Rooney; Parker Justiss, P.C.

(57) ABSTRACT

Provided is a coiled tubing reel, a method, and a method for connecting an end of coiled tubing string to a coiled tubing reel. The coiled tubing reel, in one aspect, includes a drum having a first end and a second end, and first and second flanges coupled to the drum, the first and second flanges configured to axially and radially support a coiled tubing string wound upon the drum. In one or more aspects, the coiled tubing reel further includes a coiled tubing exit opening extending through a sidewall thickness (t) of the first flange proximate a junction wherein the first flange couples to the drum, the coiled tubing exit opening configured to allow a radially interior end of the coiled tubing string to exit the first flange at a reduced angle.

22 Claims, 36 Drawing Sheets

600

600

600

600

600

600

800

COILED TUBING REEL HAVING A COILED TUBING EXIT OPENING EXTENDING THROUGH A SIDEWALL THICKNESS (t) OF THE FLANGE

BACKGROUND

Coiled or spoolable tubing is commonly used in various oil and gas operations, which include drilling of wellbores, work over operations, completion operations and production operations, among others. Coiled tubing is a continuous tubing that is spooled on a coiled tubing reel as a conveying device for one or more downhole tools. An injector is typically used to run the coiled tubing into and out of the wellbore. For drilling, a bottom hole assembly carrying a drill bit at its bottom (downhole) end may be attached to the coiled tubing's bottom end. The coiled tubing is hollow or has a through passage, which acts as a conduit for the drilling and process fluid to be supplied downhole under pressure from the surface. For completion and workover operations, the coiled tubing may be used to convey one or more devices into and/or out of the wellbore.

BRIEF DESCRIPTION

Reference is now made to the following descriptions taken in conjunction with the accompanying drawings, in which.

Figure 8A:
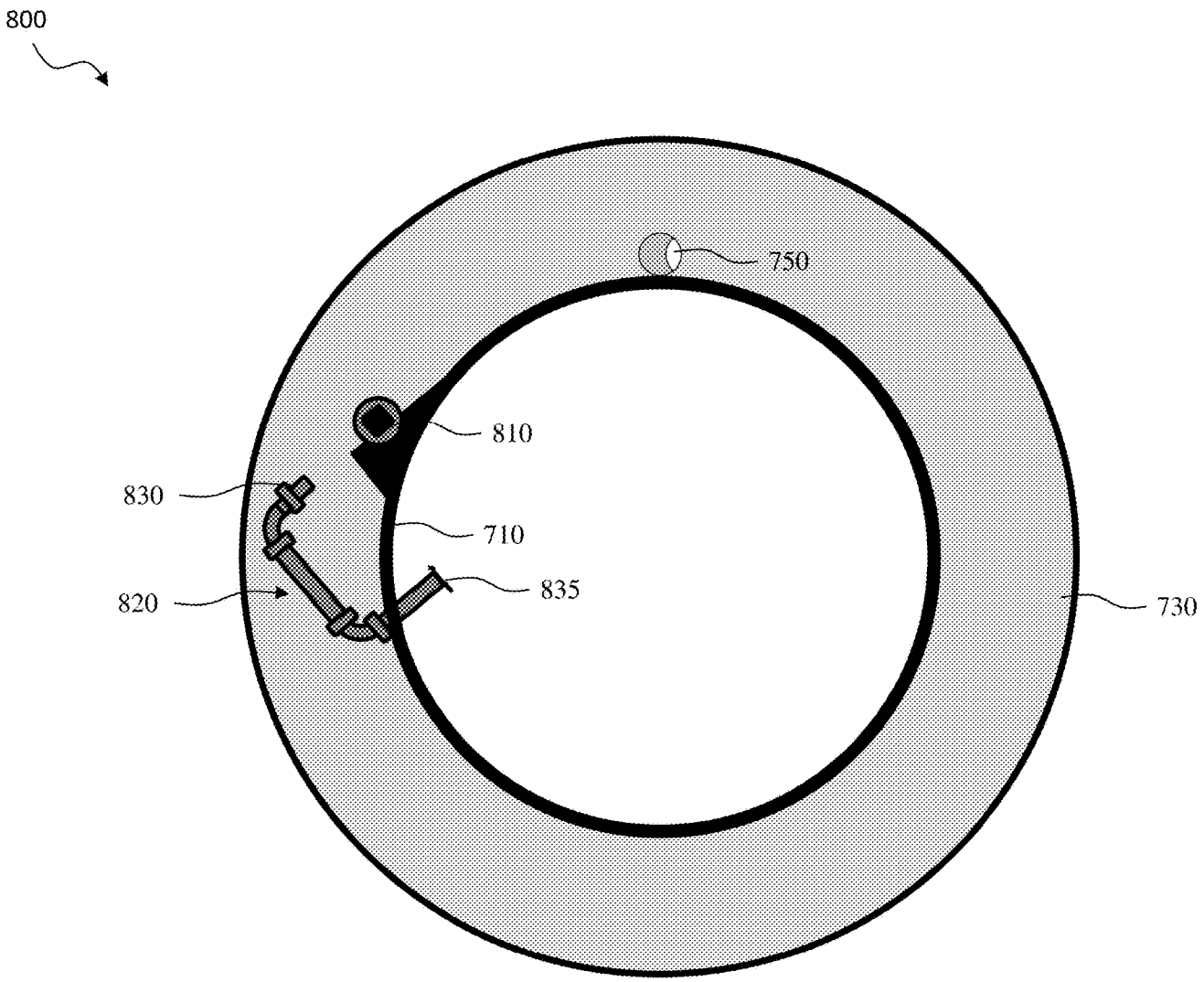
Figure 8B:
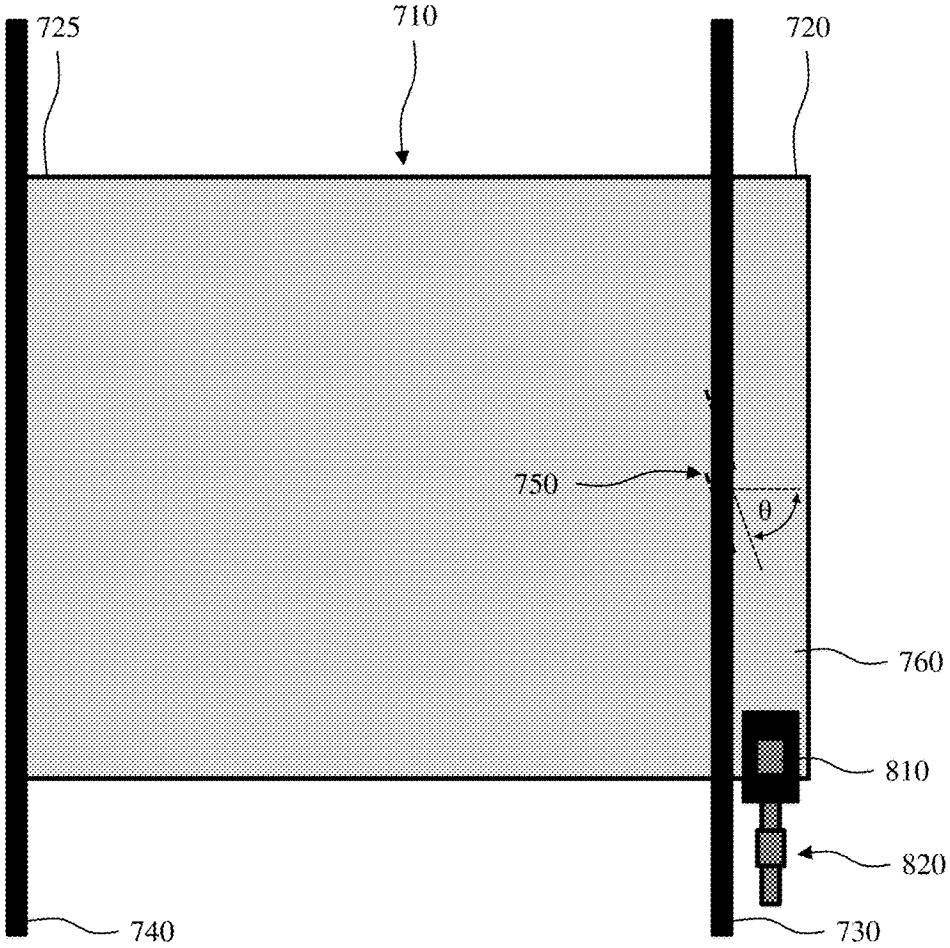
Figure 9A:
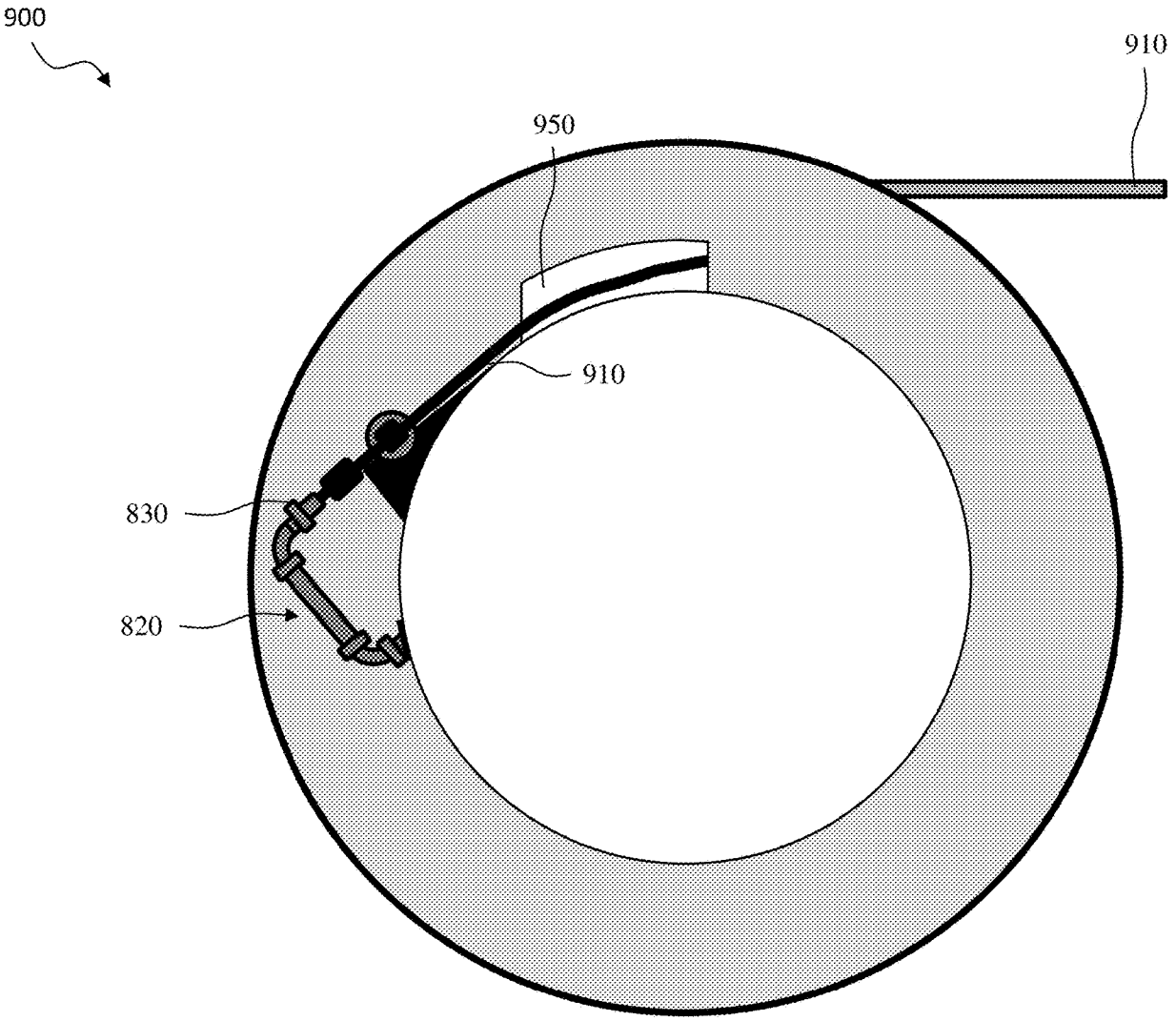
Figure 9B:
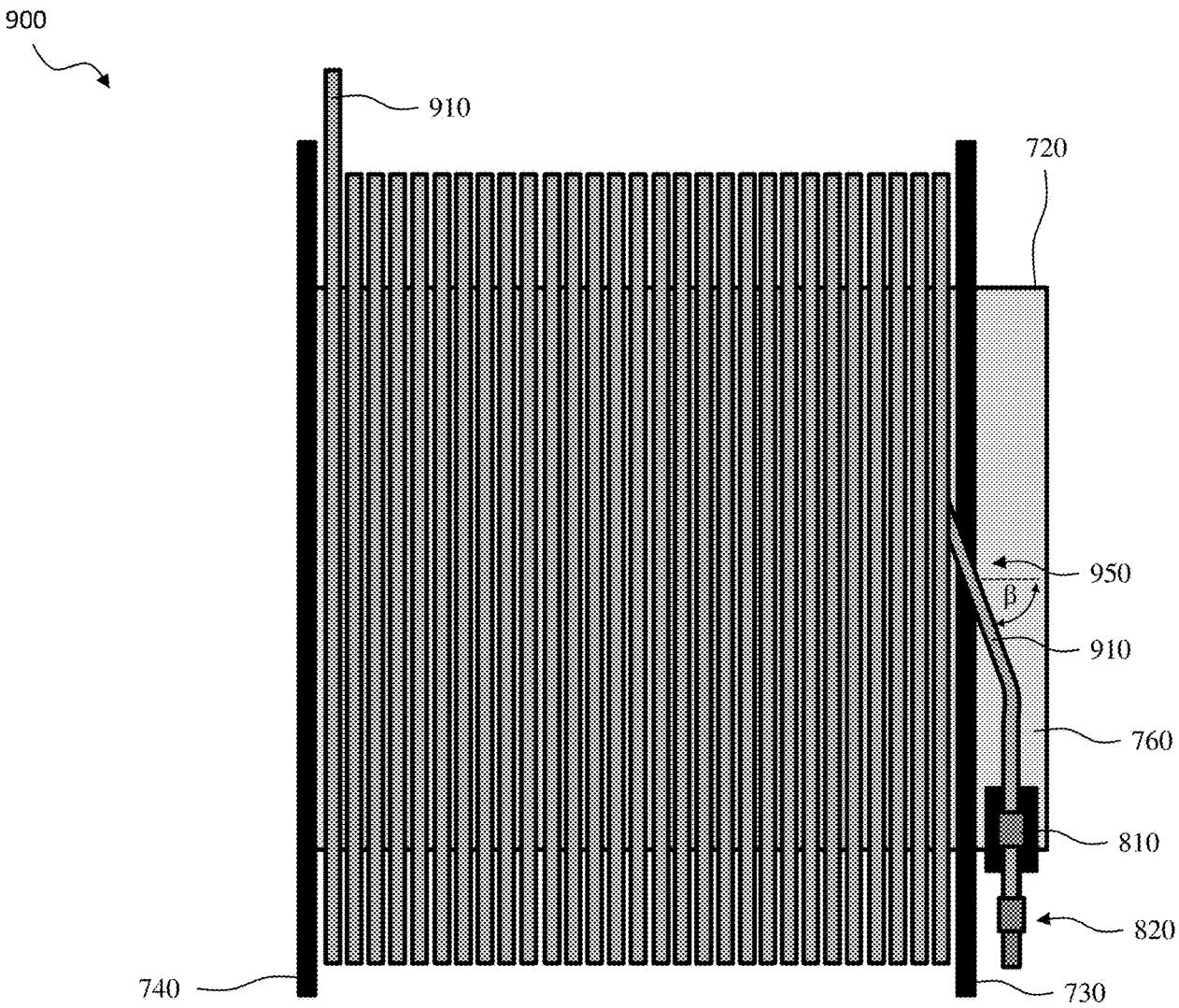

FIGS. 8A and 8B illustrate various different views of a coiled tubing reel designed, manufactured and/or operated according to one or more embodiments of the disclosure, and as might be used with a well system, such as the well systems described herein; and FIGS. 9A and 9B illustrate various different views of a coiled tubing reel designed, manufactured and/or operated according to one or more embodiments of the disclosure, and as might be used with a well system, such as the well systems described herein.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles, aspects or embodiments of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The global trend sees wells increasing in length, especially lateral length (e.g., upwards of about 12,200 meters measured depths). Accordingly, some operators are drilling wells they know cannot be accessed by conventional light intervention methods. Current light intervention methods are limited to the maximum reach capability of coiled tubing string, based on the maximum length of tubing that can be combined on a single spool. The spool capacity is often capped by the maximum transport load of a trailer, the maximum lift capacity of a crane, rigging space limitations, and/or simply the size of the available reels. To address these problems, the industry is attempting to move toward coupling two (e.g., or more) different coiled tubing reels together to extend the workable reach of a coiled tubing string. Unfortunately, achieving such in a workable solution has been difficult.

Therefore, aspects of the present disclosure include the better, safer, faster connecting, faster deploying, faster retrieving and faster disconnecting of such coiled tubing strings. In at least one embodiment, this is achieved employing a dual tubing guide system, in which the upper tubing guide can be moved relative to the lower tubing guide (e.g., to a secondary position), such that a rigid coiled tubing connector (e.g., or other rigid features coupled to the coiled tubing string) associated with the coiled tubing string can be deployed without bending and/or destroying. For example, in at least one embodiment, the upper tubing guide is rotated out of the way (e.g., to its secondary position) such that the coiled tubing string and rigid coiled tubing connector can be pulled past the upper tubing guide without coming into contact therewith. Once the rigid coiled tubing connector has passed the upper tubing guide, and optionally prior to the rigid coiled tubing connector coming into contact with the lower tubing guide, the upper tubing guide may be returned to its primary position, thereby rotating the rigid coiled tubing connector back in line with the injector. In this embodiment, the rigid coiled tubing connector would effectively bypass the upper tubing guide, and thus never have to bend around the upper tubing guide to be fed to the injector.

Figure 1:
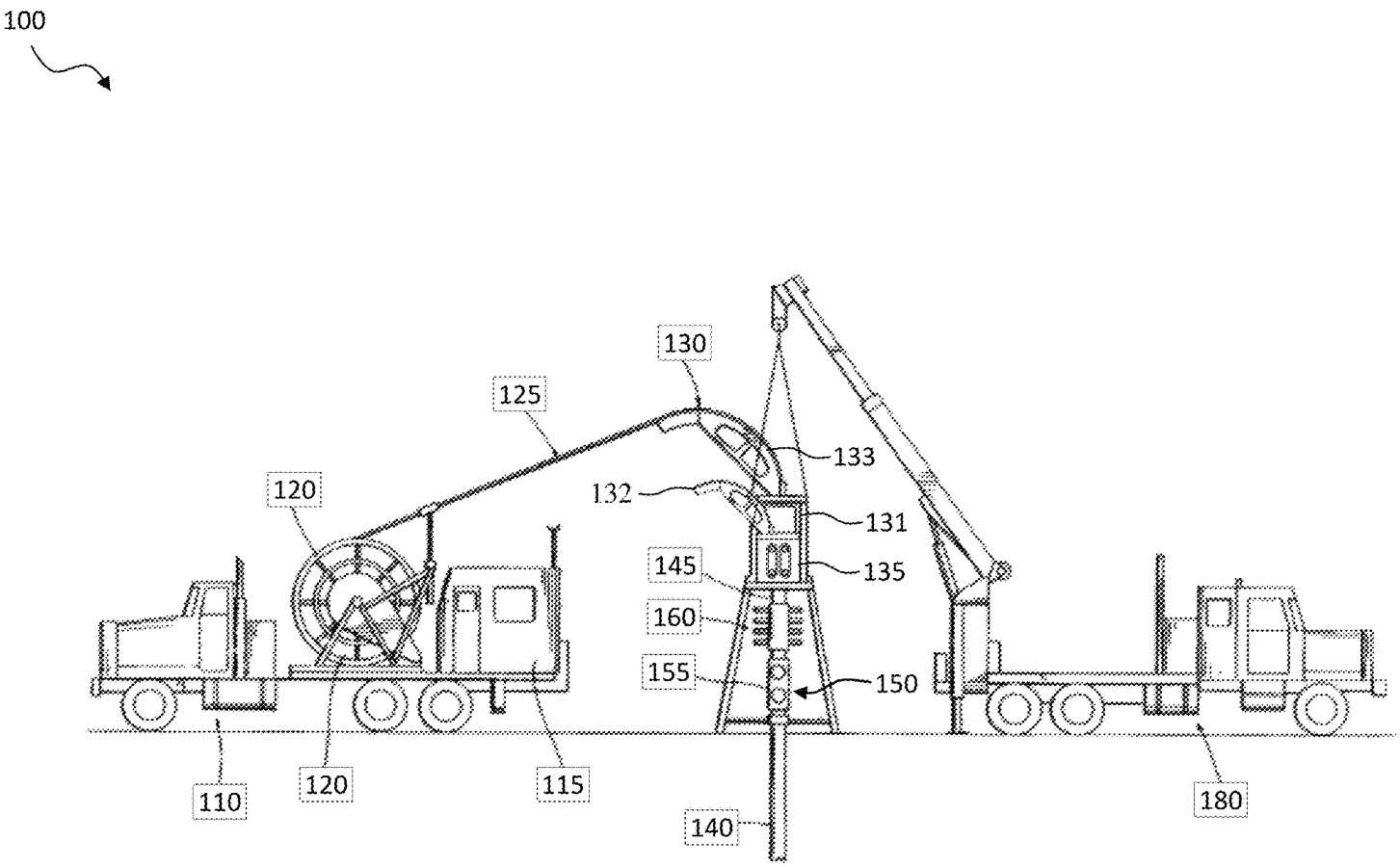
FIG. 1 illustrates a coiled tubing surface equipment spread for running coiled tubing string within a wellbore, the coiled tubing surface equipment spread designed, manufactured and operated according to the disclosure.

FIG. 1 illustrates a coiled tubing surface equipment spread 100 for running coiled tubing string, the coiled tubing surface equipment spread 100 designed, manufactured and operated according to the disclosure. In at least one embodiment, the coiled tubing surface equipment spread 100 includes a truck 110, a wellhead stack 150, and a crane truck 180. In the illustrated embodiment, the truck 110 (e.g., coiled tubing truck) carries behind its cab a power pack including a hook-up to the truck motor or power take off, hydraulic pumps and an air compressor. The coiled tubing injecting operation can be run from the control cab 115 located at the rear of truck 110. Control cab 115 may comprise the operational center. Reel 120 comprises the spool that carries the coiled tubing string to/at the job site. Reel 120 is often limited in its outside spool diameter so that, with a full load of coiled tubing string wound thereon, the reel can be trucked over the highways or waterway and to a job site.

FIG. 1 additionally illustrates a coiled tubing string 125 passed over a coiled tubing deployment/retrieval apparatus 130, and inserted into a wellbore 140 using a coiled tubing injector 135. In the illustrated embodiment, the coiled tubing deployment/retrieval apparatus 130 includes a frame 131, as well as a lower tubing guide 132 (e.g., a lower gooseneck in one embodiment) coupled to the frame 131. In this illustrated embodiment of FIG. 1, the coiled tubing deployment/retrieval apparatus 130 further includes an upper tubing guide 133 (e.g., upper gooseneck in one embodiment) coupled to the frame 131. In accordance with one aspect of the disclosure, the upper tubing guide 133 is configured to move between a primary position (e.g., shown in FIG. 1) and a secondary position (e.g., not shown in FIG. 1) relative to the lower tubing guide 132. In at least one embodiment, the secondary position is configured to allow a rigid connector of the coiled tubing string 125 to at least partially bypass the upper tubing guide 133.

Coiled tubing injector 135 often involves two hydraulic motors and two counter-rotating chains by means of which the coiled tubing injector 135 grips the coiled tubing string 125 and spools or unspools the coiled tubing string 125 to and from the reel 120. Coiled tubing stripper 145 provides a pressure barrier between coiled tubing string 125 and the wellbore 140. The wellhead stack 150 is illustrated as having a typical well Christmas tree 155 and blowout preventer 160. The crane truck 180 provides lifting means for working at the well site.

Figure 2A:
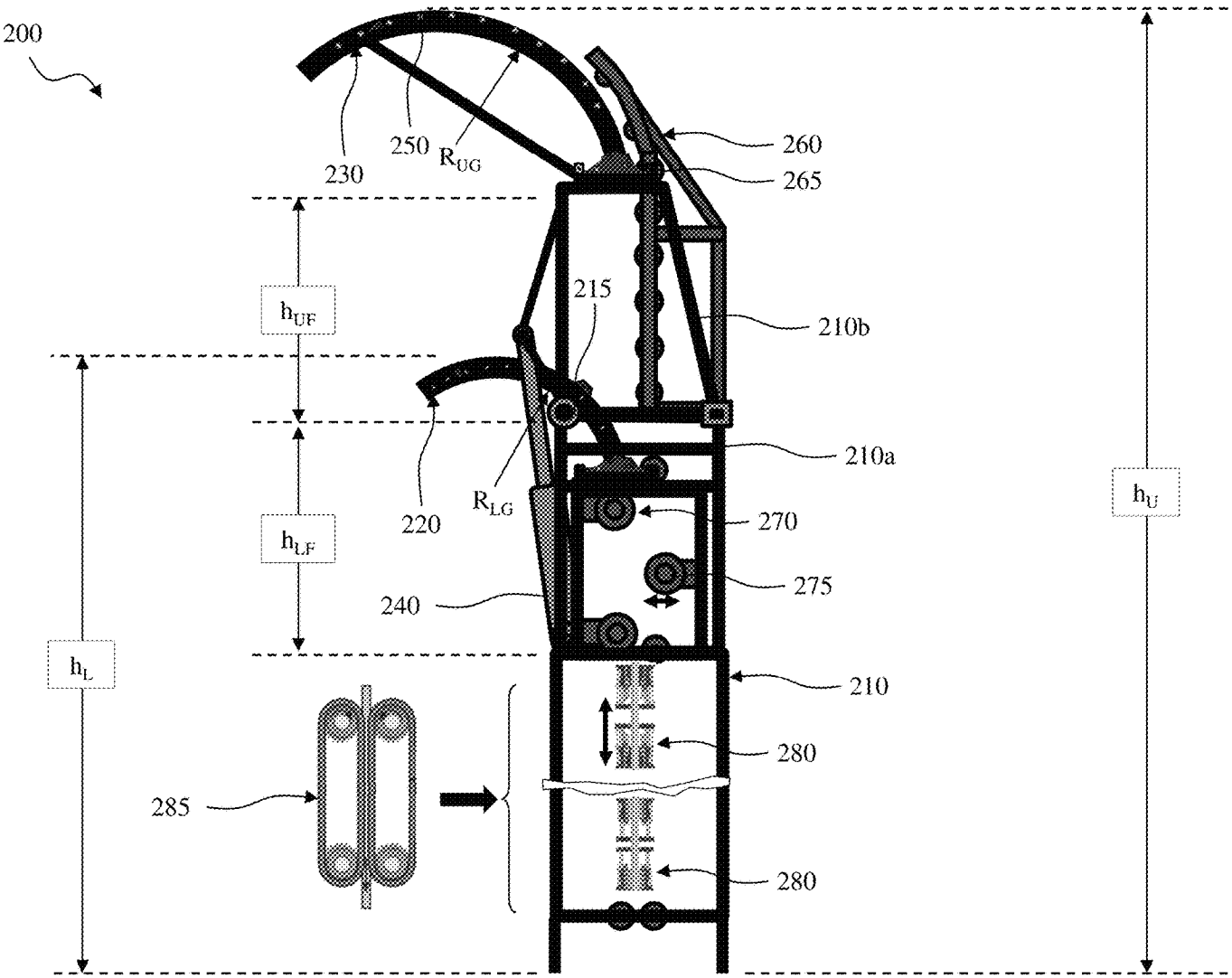
FIGS. 2A and 2B, illustrate various different operational states of a coiled tubing deployment/retrieval apparatus designed, manufactured and/or operated according to one or more embodiments of the disclosure.
Figure 2B:
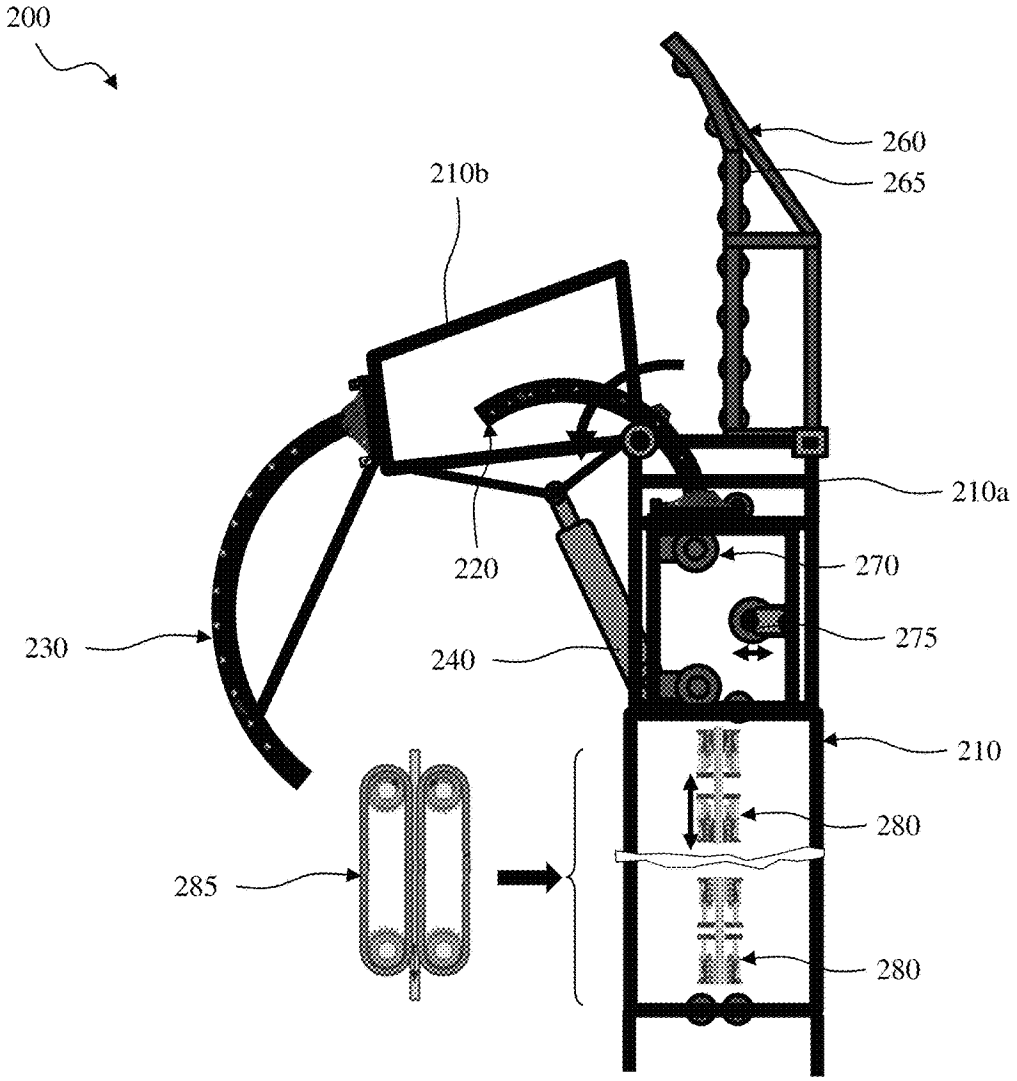

Turning to FIGS. 2A and 2B, illustrated are various different operational states of a coiled tubing deployment/retrieval apparatus 200 designed, manufactured and/or operated according to one or more embodiments of the disclosure. The coiled tubing deployment/retrieval apparatus 200, in the illustrate embodiment, includes a frame 210. In the illustrated embodiment of FIGS. 2A and 2B, the frame 210 is separated into a lower frame portion 210*a* and an upper frame portion 210*b*.

The coiled tubing deployment/retrieval apparatus 200, in one or more embodiments, further includes a lower tubing guide 220 (e.g., lower gooseneck in one embodiment) coupled to the frame 210 (e.g., to the lower frame portion 210*a*) as well as an upper tubing guide 230 (e.g., upper gooseneck in one embodiment) coupled to the frame 210 (e.g., the upper frame portion 210*b*). In accordance with one embodiment of the disclosure, the upper tubing guide 230 is configured to move between a primary position (e.g., as shown in FIG. 2A) and a secondary position (e.g., as shown in FIG. 2B) relative to the lower tubing guide 220. In accordance with one or more embodiments, the secondary position is configured to allow a rigid connector (e.g., not shown) of a coiled tubing string to at least partially bypass the upper tubing guide 230.

The upper tubing guide 230, in one or more embodiments, is described as moving relative to the lower tubing guide 220. For example, it is envisioned that the upper tubing guide 220 may axially and/or rotationally move relative to the lower tubing guide 220. Nevertheless, in the embodiment of FIGS. 2A and 2B, the upper tubing guide 230 is configured to rotate between the primary position and the secondary position relative to the lower tubing guide 220. For example, when the frame 210 includes the lower frame portion 210*a* and the upper frame portion 210*b*, the upper frame portion 210*b* may be rotationally coupled to the lower frame portion 210*a* about a rotation point 215. As the lower tubing guide 220 is coupled to the lower frame portion 210*a* and the upper tubing guide 230 is coupled to the upper frame portion 210*b* (e.g., at least in this embodiment), the rotation point 215 allows the upper tubing guide 230 to rotate between the primary position and the secondary position relative to the lower tubing guide 220.

In one or more embodiments, such as that shown in FIGS. 2A and 2B, a telescoping cylinder 240 is positioned between the lower frame portion 210*a* and the upper frame portion 210*b*. In accordance with this one embodiment, the telescoping cylinder 240 is configured to move the upper tubing guide 230 between the primary position and the secondary position. The telescoping cylinder 240, in at least one embodiment, is a hydraulic telescoping cylinder. In at least one other embodiment, the telescoping cylinder 240 is an electric telescoping cylinder.

The frame 210, and more particularly the lower frame portion 210*a* and the upper frame portion 210*b*, may be appropriately designed, sized and shaped, such that the rigid coiled tubing connector may reside between the lower tubing guide 220 and the upper tubing guide 230 when the upper tubing guide 230 is in the secondary position. Accordingly, in at least one embodiment, the lower frame portion 210*a* has a height ($h_{LF}$) and the upper frame portion 210*b* has a height ($h_{UF}$), the height ($h_{UF}$) being great enough to allow ample space for the rigid connector to reside between the lower tubing guide 220 and the upper tubing guide 230 when the upper tubing guide 230 is in the secondary position.

Similarly, the lower tubing guide 220 and the upper tubing guide 230 may also be appropriately designed, sized and shaped, such that the rigid coiled tubing connector may reside between the lower tubing guide 220 and the upper tubing guide 230 when the upper tubing guide 230 is in the secondary position. Accordingly, in at least one embodiment, the lower tubing guide 220 has a height ($h_L$) and the upper tubing guide 230 has a height ($h_U$), and further wherein a totality of the upper tubing guide 230 is located below the height ($h_L$) of the lower tubing guide 220 when the upper tubing guide 230 is in its secondary position relative to the lower tubing guide 220.

In yet one other embodiment, the lower tubing guide 220 has a first radius of curvature ($R_{LG}$) and the upper tubing guide 230 has a second different radius of curvature ($R_{UG}$), and the first radius of curvature ($R_{LG}$) and the second different radius of curvature ($R_{UG}$) may be chosen to make sure that the totality of the upper tubing guide 230 is located below the height ($h_L$) of the lower tubing guide 220 when the upper tubing guide 230 is in its secondary position relative to the lower tubing guide 220. Accordingly, in at least one embodiment, the first radius of curvature ($R_{LG}$) is less than the second different radius of curvature ($R_{UG}$). In at least one embodiment, as shown, each of the upper tubing guide 230 and the lower tubing guide 220 further includes a plurality of rollers 250 for guiding coiled tubing string.

The coiled tubing deployment/retrieval apparatus 200, in one or more embodiments, may further include a coiled tubing pipe support frame 260, for example including additional coiled tubing guiding rollers 265. The coiled tubing deployment/retrieval apparatus 200, in one or more embodiments, may further include an optional coiled tubing straightener 270, for example including one or more translatable rolling features 275. Moreover, depending on whether THE coiled tubing deployment/retrieval apparatus 200 is operated as a hydraulic workover unit or a coiled tubing injector system, the coiled tubing deployment/retrieval apparatus 200 may additionally include a collection of travelling/stationary slips 280, or grippers and rollers 285, respectively.

FIGS. 3A through 3F illustrate a method for deploying/retrieving coiled tubing in accordance with one or more embodiments of the disclosure within a well system 300. With initial reference to FIG. 3A, the well system 300 initially includes a first coiled tubing reel 310. In at least one embodiment, as shown, the first coiled tubing reel 310 includes a first coiled tubing string 320 placed thereon. In at least one embodiment, as shown, the first coiled tubing string 320 is wound around the first coiled tubing reel 310. The first coiled tubing string 320 may comprise many different coiled tubing string types and sizes and remain within the purview of the disclosure.

Figure 3A:
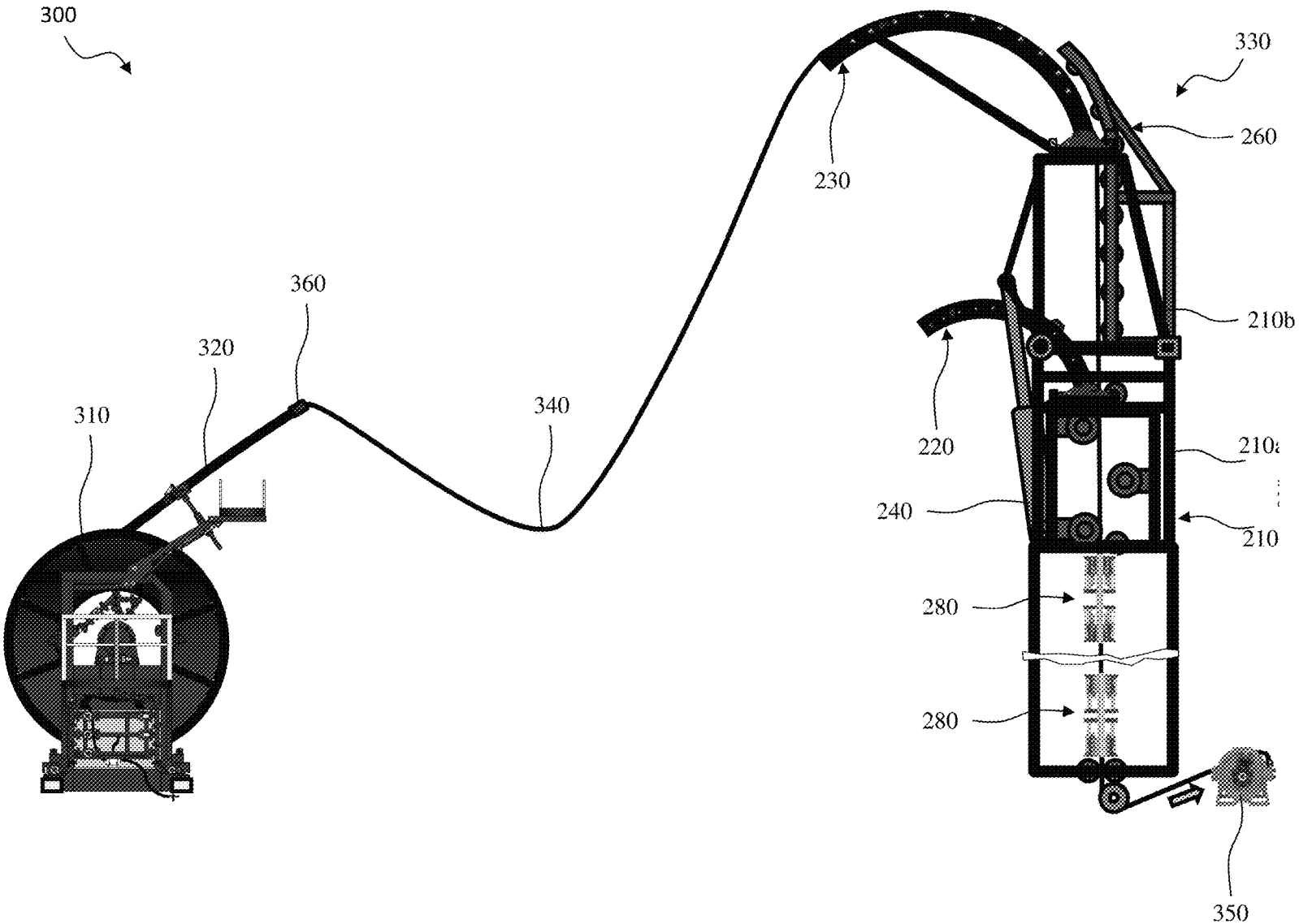
FIGS. 3A through 3F illustrate a method for deploying/retrieving coiled tubing in accordance with one or more embodiments of the disclosure within a well system.

The well system 300, in the illustrated embodiment of FIG. 3A, additionally includes a coiled tubing deployment/retrieval apparatus 330 designed, manufactured and/or operated according to one or more embodiments of the disclosure. The coiled tubing deployment/retrieval apparatus 330 of FIG. 3A is similar in many respects to the coiled tubing deployment/retrieval apparatus 200 of FIGS. 2A and 2B. Accordingly, like reference numbers have been used to indicate similar, if not identical, features.

In the embodiment illustrated in FIG. 3A, the upper tubing guide 230 is located in its primary position. Furthermore, an uphole end of a winch cable 340 is coupled to the downhole end of the first coiled tubing string 320, and a downhole end of the winch cable 340 is coupled to a winch 350. In the illustrated embodiment, the winch cable 340 is pulled over the upper tubing guide 230, between the upper tubing guide 230 and the coiled tubing pipe support frame 260, through the optional coiled tubing straightener 270 and into the collection of travelling/stationary slips 280 using the winch 350. As shown in the embodiment of FIG. 3A, a rigid coil tubing connector 360 couples the first coiled tubing string 320 and the winch cable 340.

Figure 3B:
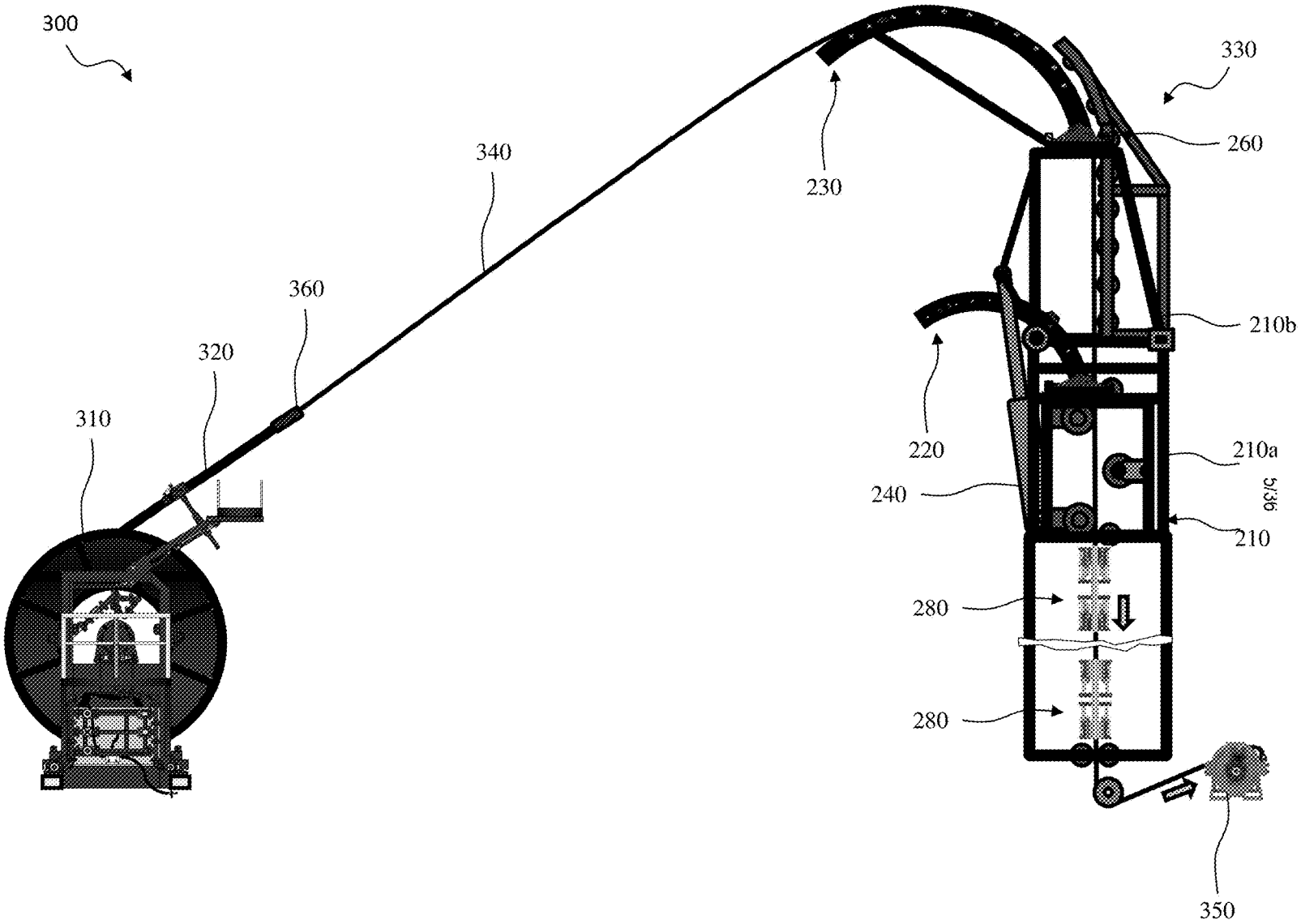

Turning now to FIG. 3B, the winch 350 has been engaged, the winch 350 pulling the winch cable 340 tight over the upper tubing guide 230 and down through the collection of travelling/stationary slips 280.

Figure 3C:
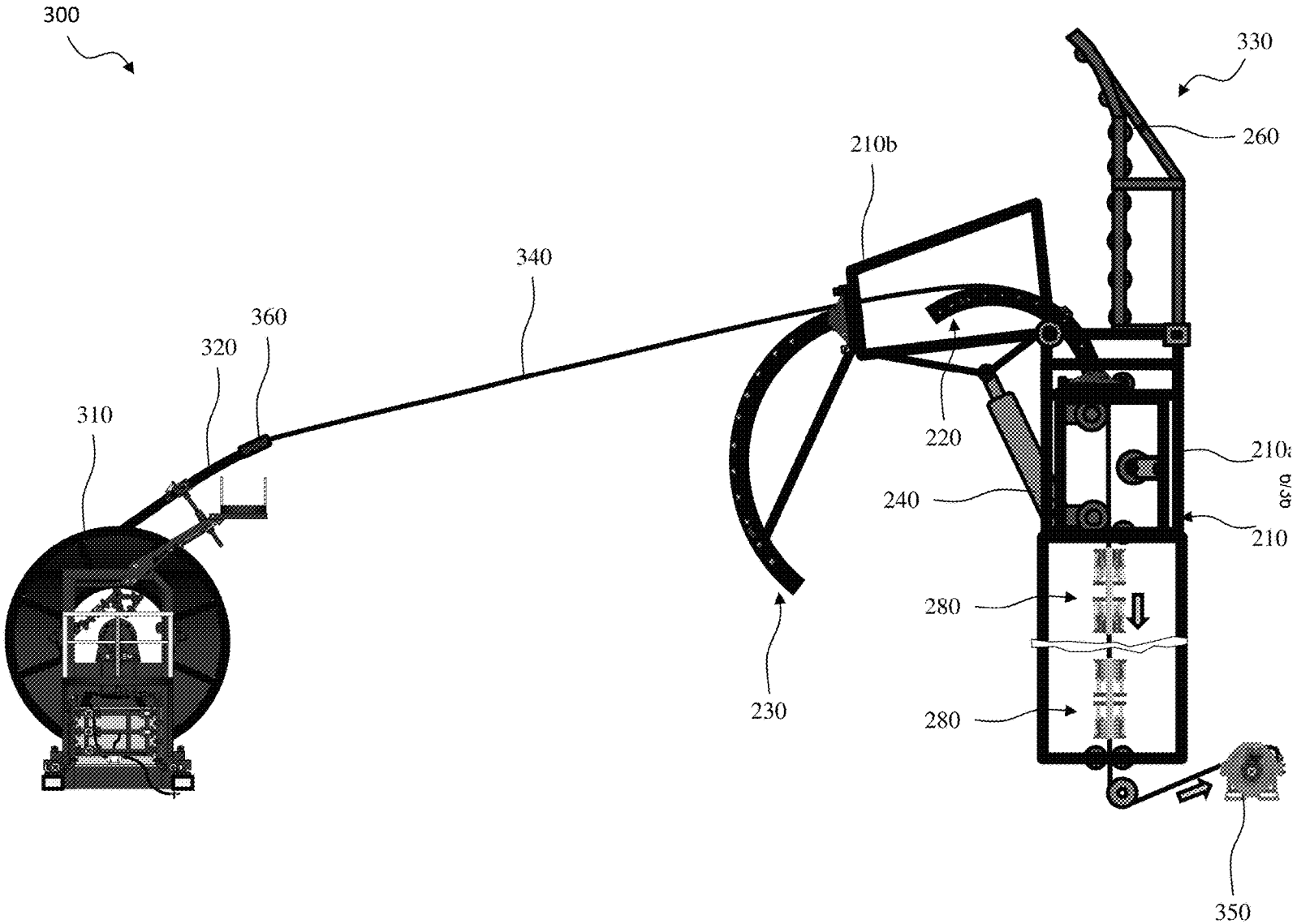
Figure 3D:
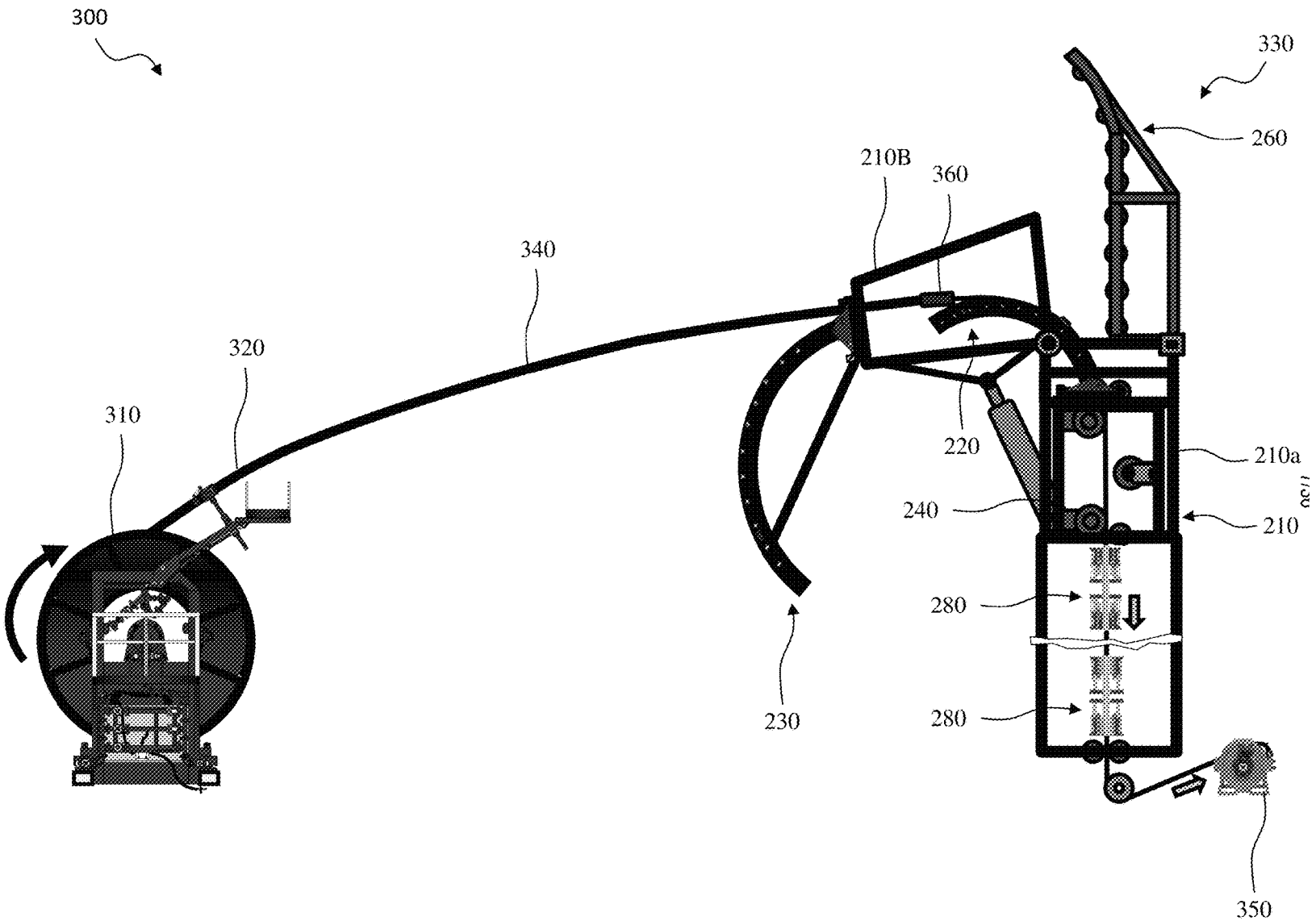

Turning now to FIG. 3C, the upper tubing guide 230 has been moved (e.g., rotated) from the primary position to the secondary position relative to the lower tubing guide 220. As shown, the secondary position allows the rigid coil tubing connector 360 of the first coiled tubing string 320 to at least partially (e.g., if not fully) bypass rolling over the upper tubing guide 230. In the illustrated embodiment, the rigid coil tubing connector 360 and the first coiled tubing string 320 have yet to be pulled by the winch 350. In yet other embodiments, however, the rigid coil tubing connector 360 and the first coiled tubing string 320 may have been pulled a short distance (e.g., a distance less than a distance between the rigid coil tubing connector 360 and the upper tubing guide 230) prior to moving the upper tubing guide 230 from the primary position to the secondary position.

Turning now to FIG. 3D, the winch 350 has again been engaged, the winch 350 pulling the winch cable 340 and the associated rigid coil tubing connector 360 and first coiled tubing string 320. In the illustrated embodiment, given the location of the upper tubing guide 230 in the secondary position, the rigid coil tubing connector 360 is allowed to pass the upper tubing guide 230 (e.g., in one embodiment without any contact therewith) and enter the frame 210 (e.g., upper frame portion 210*b*). At this stage, the rigid coil tubing connector 360 has either yet to engage with the lower tubing guide 220, or has just initially engaged with the lower tubing guide 220.

Figure 3E:
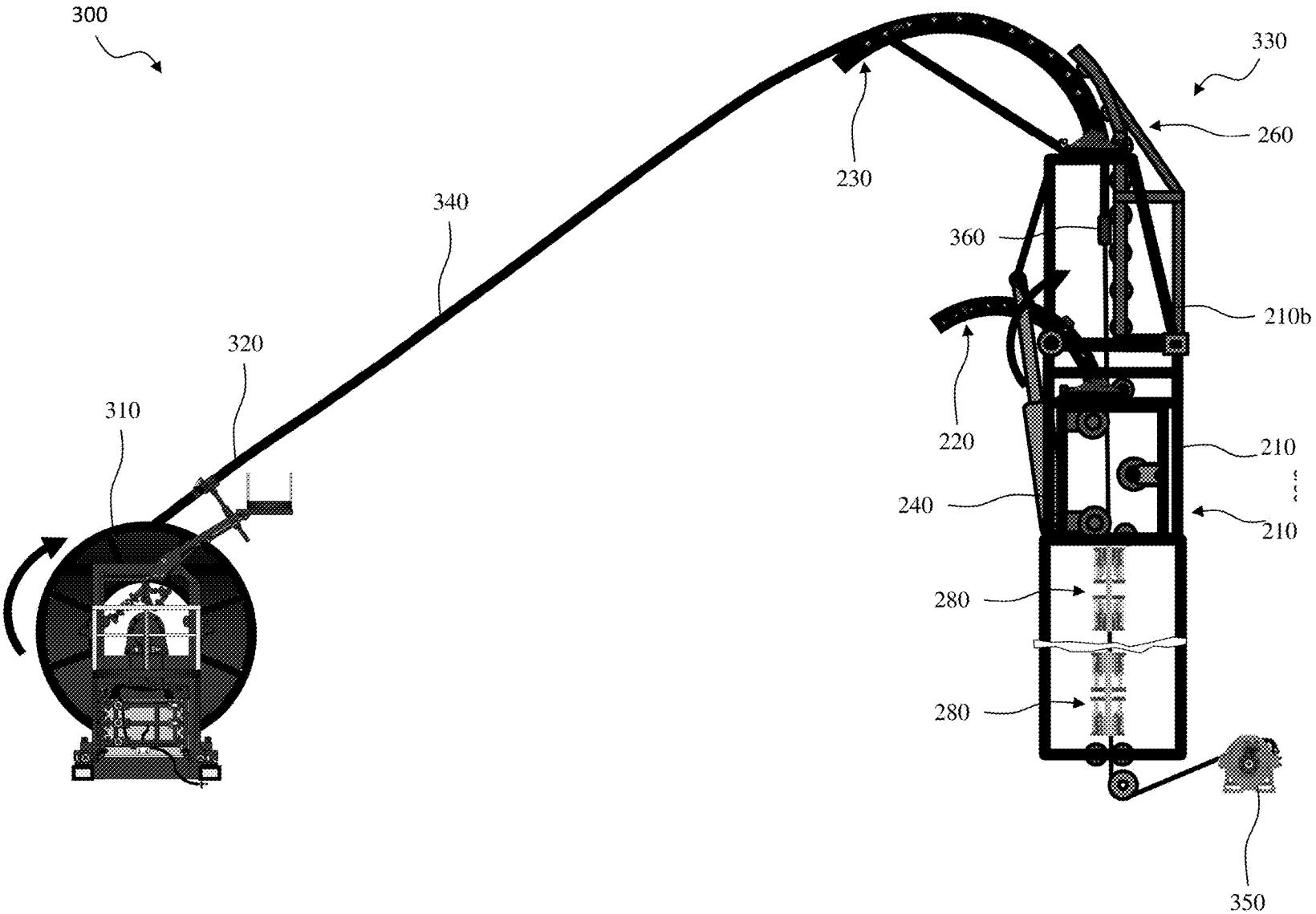

Turning now to FIG. 3E, the upper tubing guide 230 has been returned from the secondary position to the primary position, for example while holding tension on the winch cable 340 using the winch 350. This allows the first coiled tubing reel 310 to rotate with back tension, thereby pulling additional length of the first coiled tubing string 320 from the first coiled tubing reel 310. In one or more embodiments, the upper tubing guide 230 is now secured in the primary position, for example by locking the upper frame portion 210*b* and the lower frame portion 210*a* to one another.

Figure 3F:
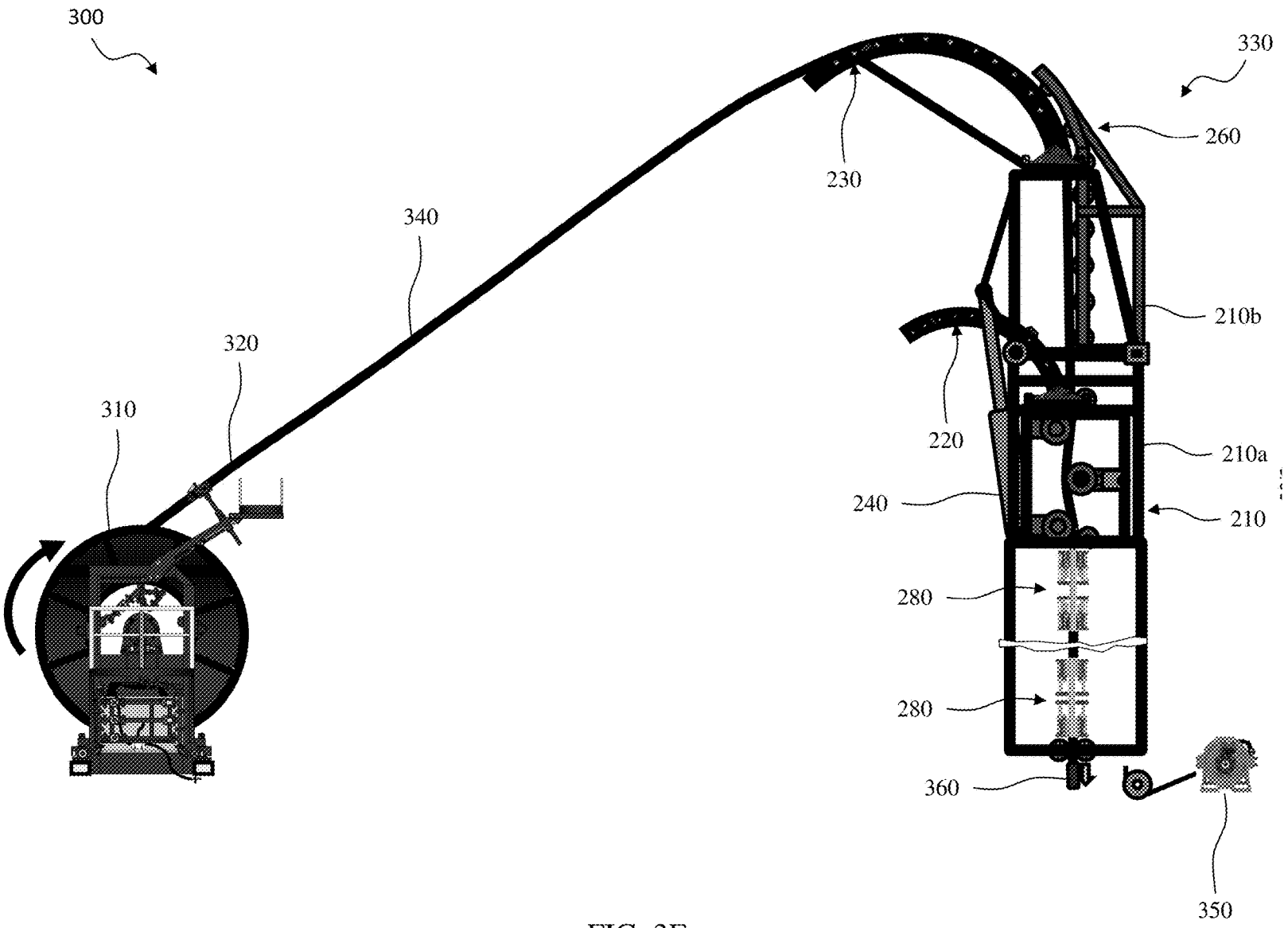

Turning now to FIG. 3F, the winch 350 has continued to pull the winch cable 340 and the rigid coil tubing connector 360 through the collection of travelling/stationary slips 280. Furthermore, the optional coiled tubing straightener 270 may be used to straighten the first coiled tubing string 320, as needed. The winch 350 continues to pull the winch cable 340 through the optional coiled tubing straightener 270 until the rigid coil tubing connector 360 passes the bottom of the collection of travelling/stationary slips 280. At this stage, the travelling/stationary slips 280 may engage the first coiled tubing string 320, and the winch cable 340 may be disconnected from the rigid coil tubing connector 360. The process for inserting the first coiled tubing string 320 within the wellbore may now continue in a conventional matter.

While the embodiment of FIGS. 3A through 3F illustrates the process for inserting the first coiled tubing string 320 within the wellbore, those skilled in the art understand that the process could be reversed when pulling the first coiled tubing string 320 from the wellbore, and ultimately disconnecting the first coiled tubing string 320 from the winch cable 340.

FIGS. 4A through 4G illustrate a method for deploying/retrieving coiled tubing in accordance with one or more alternative embodiments of the disclosure within a well system 400. The well system 400, in the illustrated embodiment of FIGS. 4A through 4G, additionally includes a coiled tubing deployment/retrieval apparatus 430 designed, manufactured and/or operated according to one or more embodiments of the disclosure. The method, the well system 400 and the coiled tubing deployment/retrieval apparatus 430 of FIGS. 4A through 4G is similar in many respects to the method, well system 300, and coiled tubing deployment/retrieval apparatus 330 of FIGS. 3A through 3F. Accordingly, like reference numbers have been used to indicate similar, if not identical, features. The method, the well system 400 and the coiled tubing deployment/retrieval apparatus 430 of FIGS. 4A through 4G differs, for the most part, from the method, the well system 300 and the coiled tubing deployment/retrieval apparatus 330 of FIGS. 3A through 3F, in that the method, the well system 400 and the coiled tubing deployment/retrieval apparatus 430 of FIGS. 4A through 4G employs a flexible stabbing snake 405 designed, manufactured and/or operated according to one or more embodiments of the disclosure to help deploy the first coiled tubing string 320.

Figure 4A:
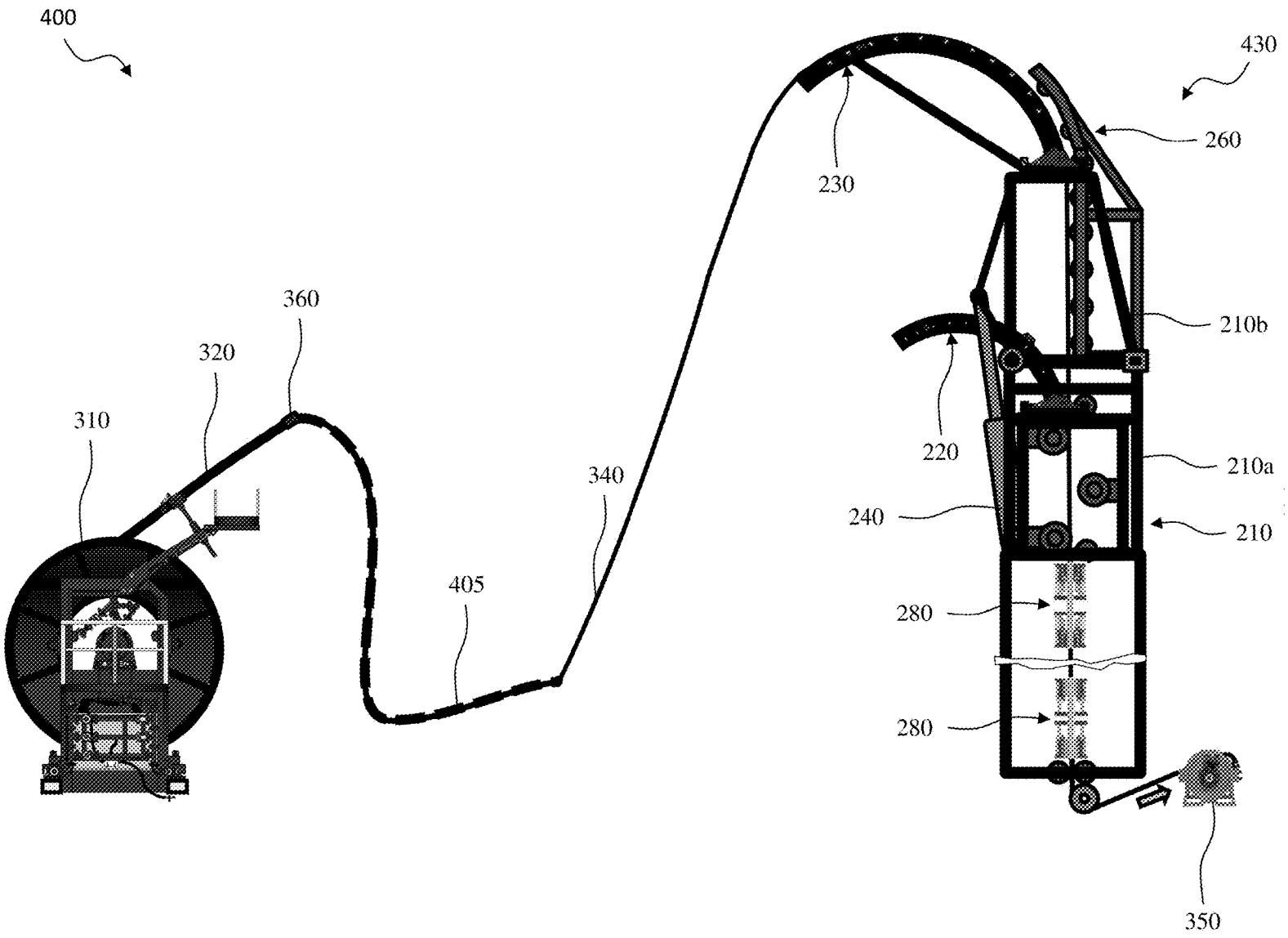
FIGS. 4A through 4G illustrate a method for deploying/retrieving coiled tubing in accordance with one or more alternative embodiments of the disclosure within a well system.
Figure 4B:
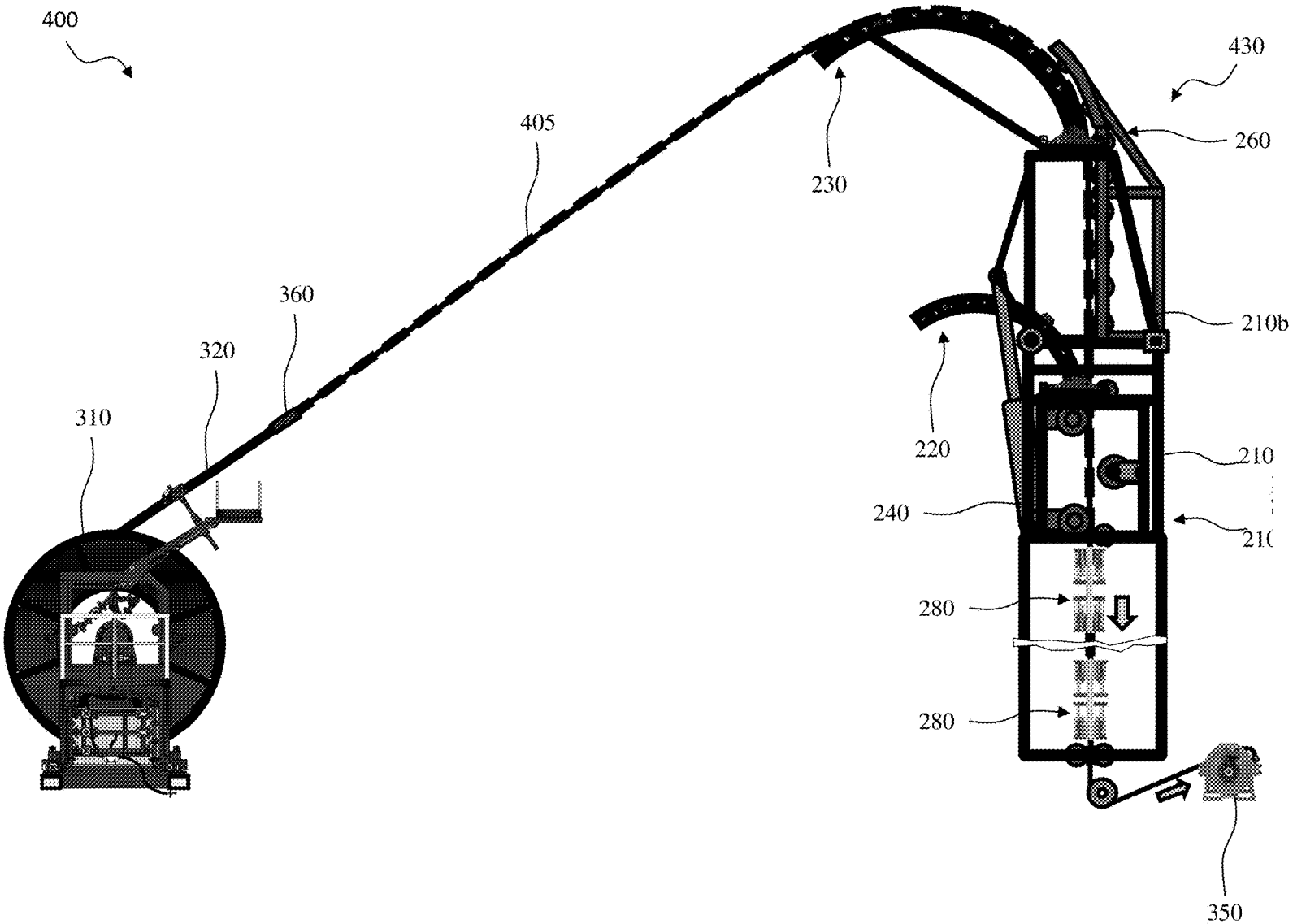
Figure 4C:
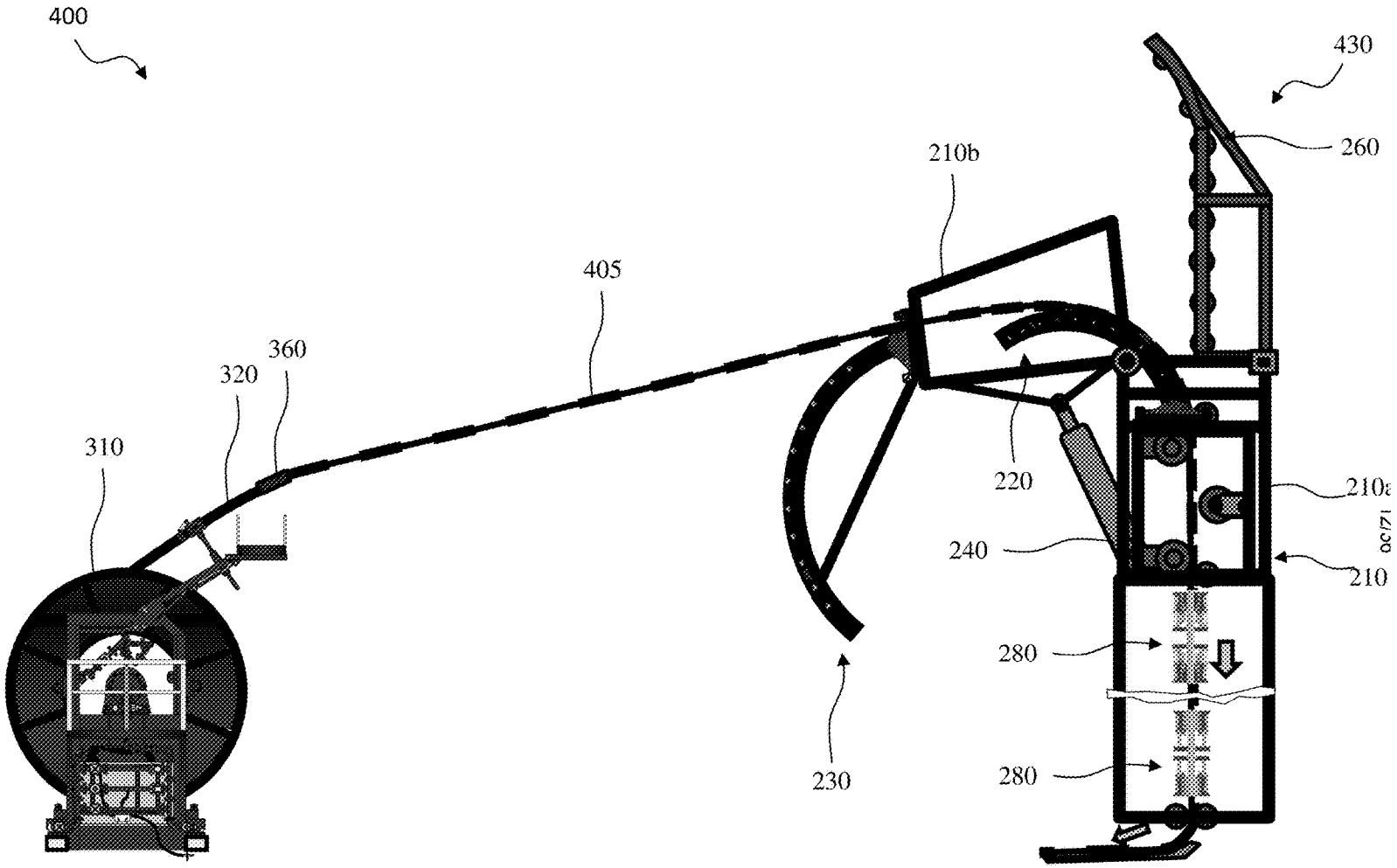
Figure 4D:
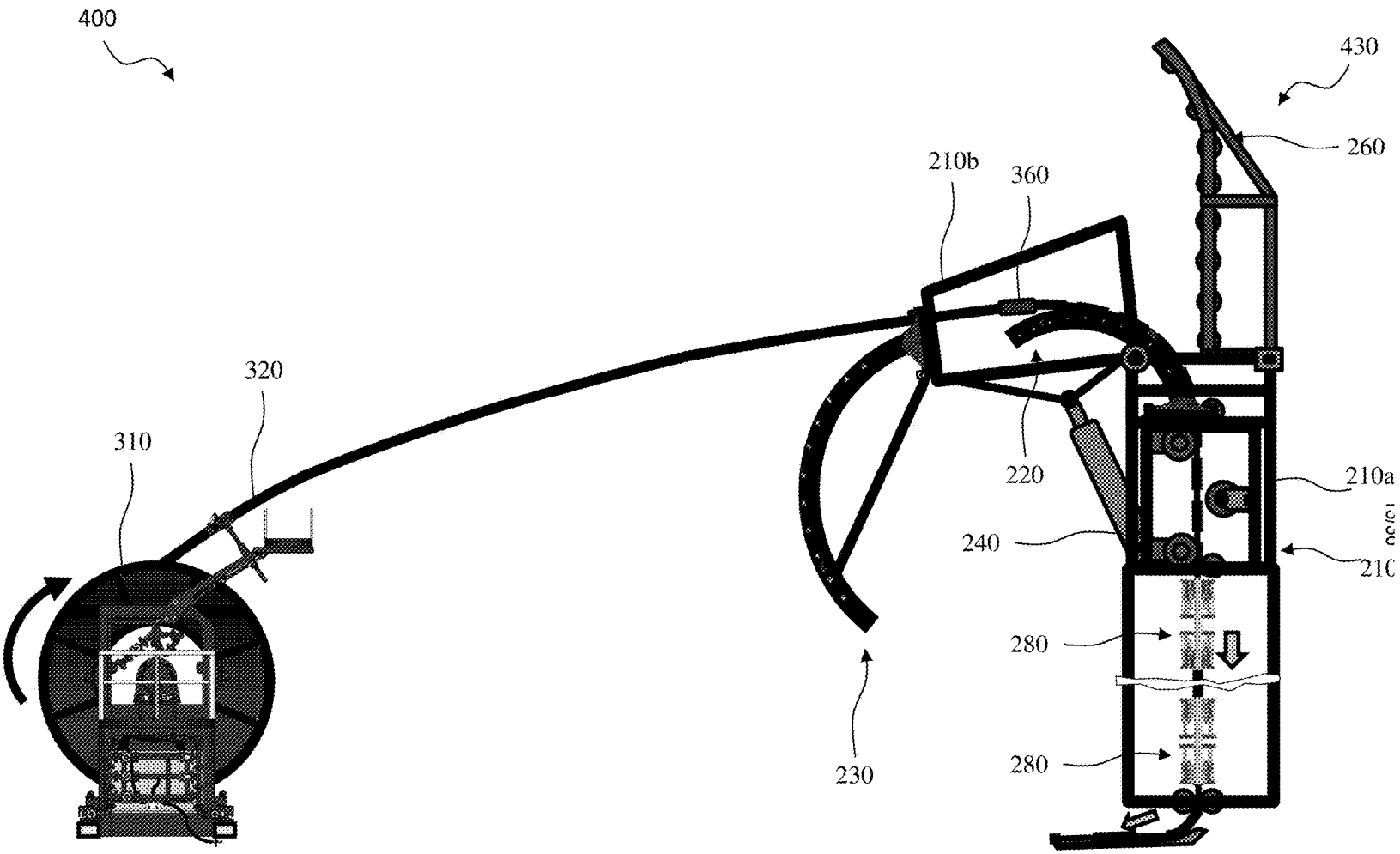
Figure 4E:
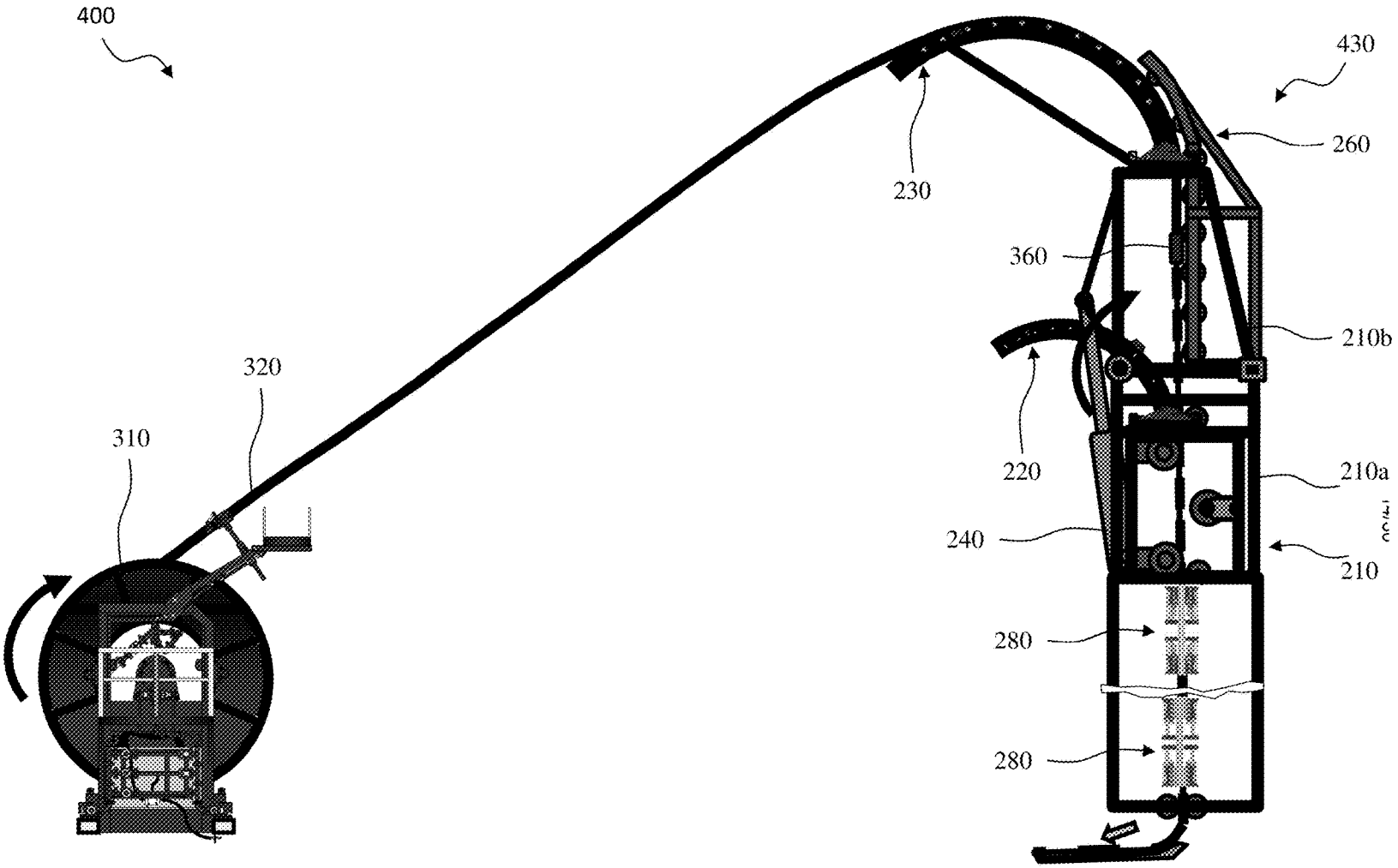
Figure 4F:
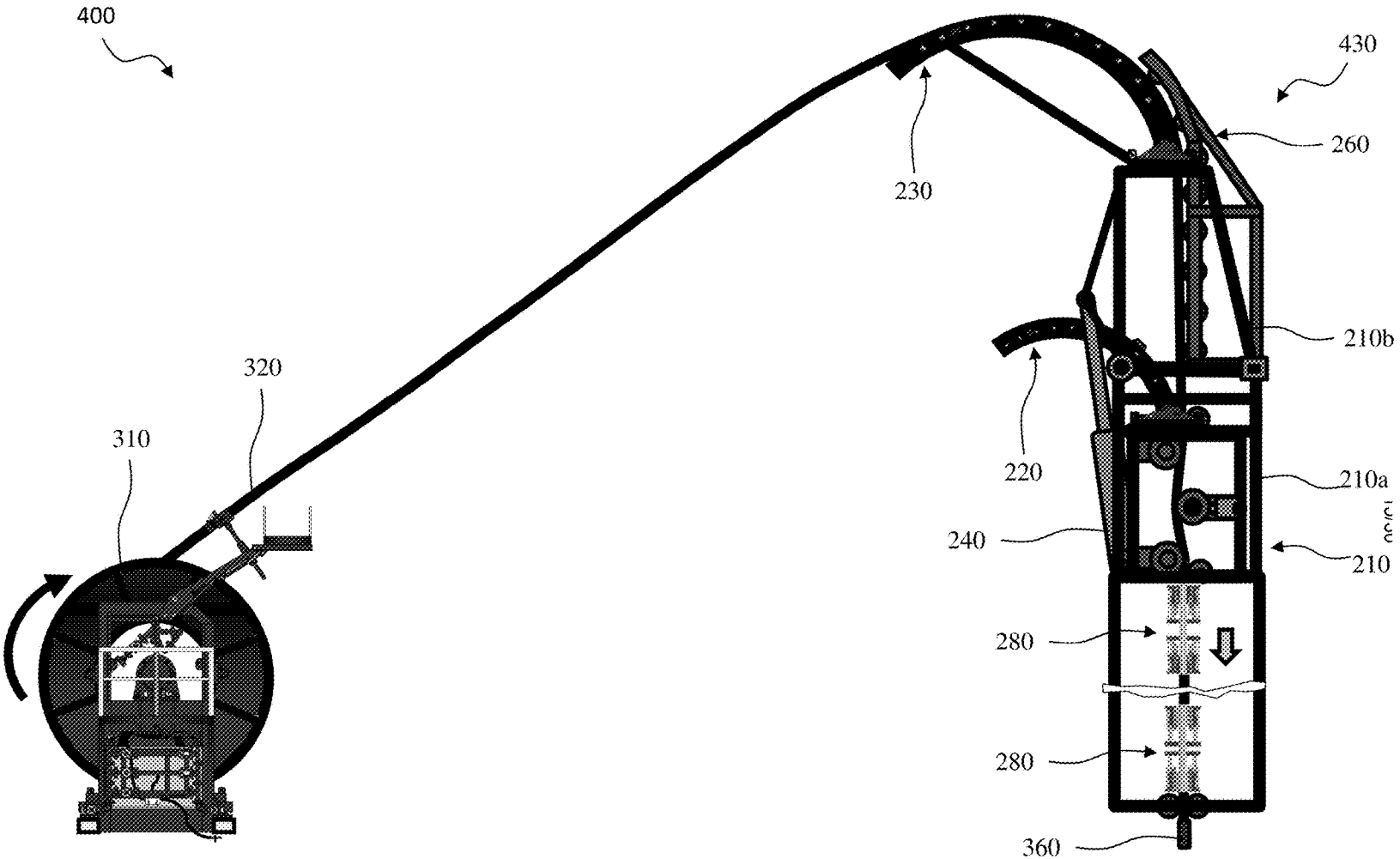
Figure 4G:
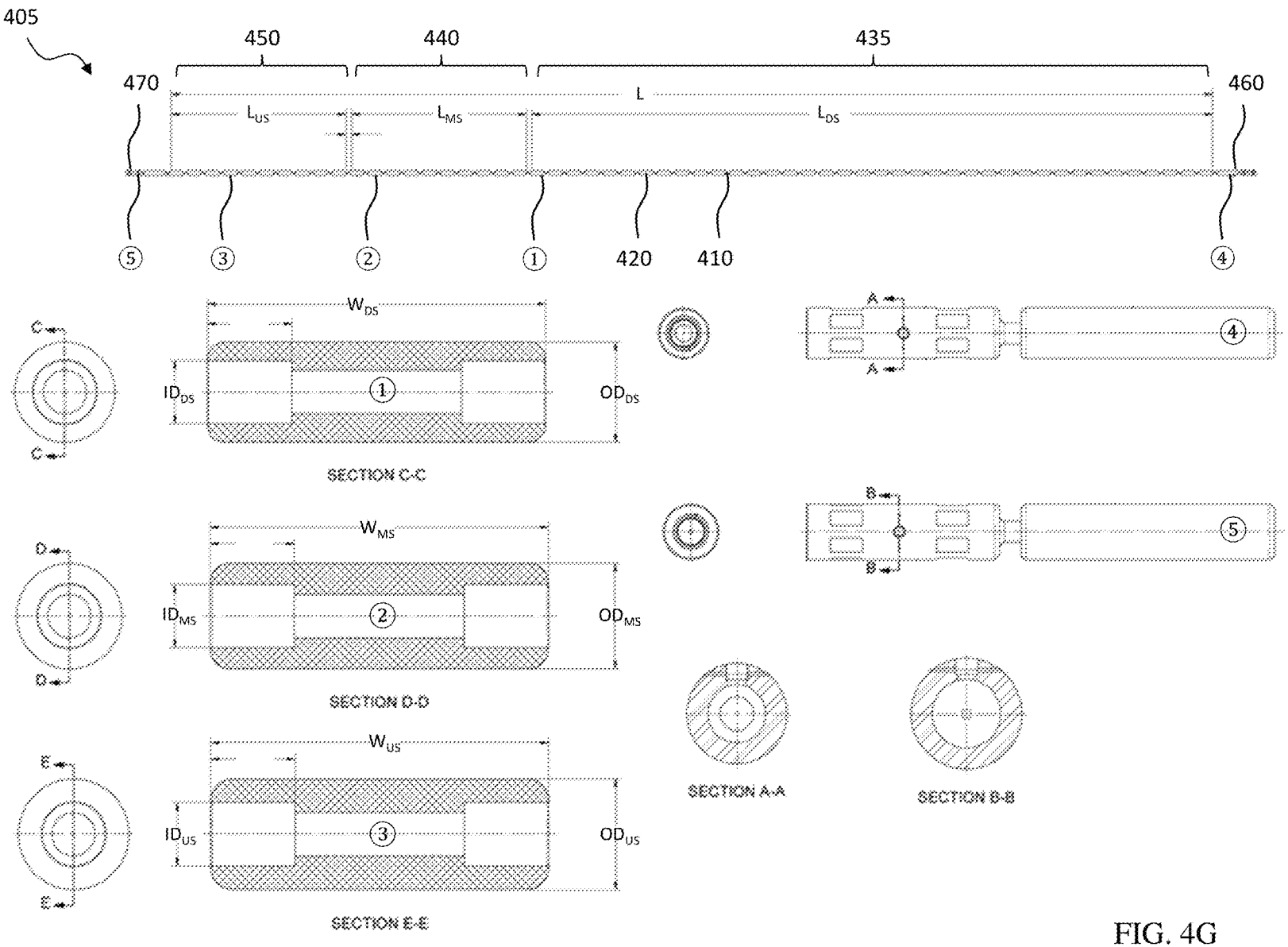

Turning to FIG. 4G, illustrated are various different views of one example of a flexible stabbing snake 405 designed, manufactured, and used according to one or more embodiments of the disclosure. In the illustrated embodiment, the flexible stabbing snake 405 includes a conveyance 410 having a plurality of spaced apart ferrules/buttons 420 coupled thereto. The ferrules/buttons 420 are spaced to substantially mimic coiled tubing string, for example as the coiled tubing string passes through the travelling/stationary slips 280. In at least one embodiment, the flexible stabbing snake 405 may have 10 or more spaced apart ferrules/buttons 420. In at least one other embodiment, the flexible stabbing snake 405 may have 20 or more spaced apart ferrules/buttons 420, and in yet another embodiment 30 or more. In one example, similar spacing is located between each of the ferrules/buttons 420. Accordingly, the flexible stabbing snake 405 having the conveyance 410 and ferrules/buttons 420 is able to provide a coupling between the first coiled tubing string 320 and the winch cable 340, but still be able to easily bend (e.g., around the lower tubing guide 220 and the upper tubing guide 230) as needed.

The conveyance 410, in one or more examples, is braided wire. In yet another embodiment, the conveyance 410 is wire rope, among other possible conveyances. The conveyance 410 may vary in length (L) based upon the design of the coiled tubing surface equipment spread and downhole assembly. Nevertheless, in at least one or more examples, the conveyance 410 is at least 6 meters (e.g., about 20 feet) long. In one or more different examples, the conveyance 410 ranges from 9 meters to 18 meters (e.g., about 30 feet to about 60 feet) long, and in yet another example the conveyance 410 ranges from 13.7 meters to 16.8 meters (e.g., about 45 feet to about 55 feet) long. Additional lengths (L) could be accommodated if warranted. The ferrules/buttons 420 may be bonded to the conveyance 610 using metallic smelter, brazing and/or one or more different swaging/crimping processes, among other processes.

In at least one embodiment, the conveyance 410 has a downhole section 435, a middle section 440 and an uphole section 450. In this embodiment, the downhole section 435 has a length ($L_{DS}$), the middle section 440 has a length ($L_{MS}$), and the uphole section 450 has a length ($L_{US}$). In accordance with at least one embodiment, the length of the downhole section ($L_{DS}$) is at least two times a length of the middle section ($L_{MS}$) and a length of the uphole section ($L_{US}$). In accordance with at least one other embodiment, the length of the downhole section ($L_{DS}$) is at least four times a length of the middle section ($L_{MS}$) and a length of the uphole section ($L_{US}$).

As shown in FIG. 4G, the ferrules/buttons 420 in the downhole section 435 may have a downhole section outside diameter ($OD_{DS}$), the ferrules/buttons 420 in the middle section 440 may have middle section outside diameter ($OD_{MS}$), and the ferrules/buttons 420 in the uphole section 450 may have an uphole section outside diameter ($OD_{US}$). In at least one embodiment, one or all of the downhole section outside diameter ($OD_{DS}$), middle section outside diameter ($OD_{MS}$), and uphole section outside diameter ($OD_{US}$) are different from one or all of the others of the downhole section outside diameter ($OD_{DS}$), middle section outside diameter ($OD_{MS}$), and uphole section outside diameter ($OD_{US}$). For example, in one embodiment the middle section outside diameter ($OD_{MS}$) is greater than the downhole section outside diameter ($OD_{DS}$), and the uphole section outside diameter ($OD_{US}$) is greater than the middle section outside diameter ($OD_{MS}$). In yet another embodiment, the middle section outside diameter ($OD_{MS}$) is less than the downhole section outside diameter ($OD_{DS}$), and the uphole section outside diameter ($OD_{US}$) is less than the middle section outside diameter ($OD_{MS}$). Accordingly, the flexible stabbing snake 405 may provide a smooth transition between a smaller diameter of the winch cable 340 and the larger diameter of the first coiled tubing string 320, if that were the case. Nevertheless, other embodiments exist wherein the downhole section outside diameter ($OD_{DS}$), middle section outside diameter ($OD_{MS}$), and uphole section outside diameter ($OD_{US}$) are the same. The change in the downhole section outside diameter ($OD_{DS}$), middle section outside diameter ($OD_{MS}$), and uphole section outside diameter ($OD_{US}$) may be gradual, step-wise, or sudden. In one example, such as that shown in FIG. 4G, the flexible stabbing snake 405 includes multiple step-wise changes in the outside diameter.

As shown in FIG. 4G, the ferrules/buttons 420 in the downhole section 435 may have a downhole section inside diameter ($ID_{DS}$), the ferrules/buttons 420 in the middle section 440 may have middle section inside diameter ($ID_{MS}$), and the ferrules/buttons 420 in the uphole section 450 may have an uphole section inside diameter ($ID_{US}$). In at least one embodiment, one or all of the downhole section inside diameter ($ID_{DS}$), middle section inside diameter ($ID_{MS}$), and uphole section inside diameter ($ID_{US}$) are the same as one another. In at least one other embodiment, one or all of the downhole section inside diameter ($ID_{DS}$), middle section inside diameter ($ID_{MS}$), and uphole section inside diameter ($ID_{US}$) are different from one another.

As shown in FIG. 4G, the ferrules/buttons 420 in the downhole section 435 may have a downhole section width ($W_{DS}$), the ferrules/buttons 420 in the middle section 440 may have a middle section width ($W_{MS}$), and the ferrules/buttons 420 in the uphole section 450 may have an uphole section width ($W_{US}$). In at least one embodiment, the downhole section width ($W_{DS}$), the middle section width ($W_{MS}$), and the uphole section width ($W_{US}$) are the same as one another. In yet another embodiment, one or more of the downhole section width ($W_{DS}$), the middle section width ($W_{MS}$), and the uphole section width ($W_{US}$) are different from each other.

The flexible stabbing snake 405, in accordance with one or more examples of the disclosure, is pull tested up to 20,000 LBF @ 1.25 safety factor (25,000 LBF). The flexible stabbing snake 405, in accordance with one or more other examples of the disclosure, is pull tested up to 40,000 LBF @ 1.25 safety factor (50,000 LBF), and in yet another example pull tested up to 60,000 LBF @ 1.25 safety factor (75,000 LBF). Furthermore, a downhole swivel 460 located at the downhole end of the conveyance 410 and an uphole swivel 470 located at the uphole end of the conveyance 410, in at least one or more examples, is pressure tested up to 2,000 PSI @ 1.25 safety factor (2,500 PSI) after 1.5" 2.90 #C.S. hydril thread and vent port process. In another example, the downhole swivel 460 located at the downhole end of the conveyance 410 and the uphole swivel 470 located at the uphole end of the conveyance 410, in at least one or more examples, is pressure tested up to 5,000 PSI @ 1.25 safety factor (6,250 PSI) after 1.5" 2.90 #C.S. hydril thread and vent port process, and in yet another example pressure tested up to 10,000 PSI @ 1.25 safety factor (12,500 PSI) after 1.5" 2.90 #C.S. hydril thread and vent port process. Thus, as shown, the flexible stabbing snake 405, including the conveyance 410 and the one or more spaced apart ferrules/buttons 420 has a fluid passageway extending entirely there through that acts as a fluid conduit, for example having the pressure test values set forth above.

Those skilled in the art, given the detail above with regards to FIGS. 3A through 3F, and the detail above with regards to the flexible stabbing snake 405, would understand the method disclosed in FIGS. 4A through 4F. Accordingly, no further detail is warranted.

FIGS. 5A through 5H illustrate a method for deploying/retrieving coiled tubing in accordance with one or more alternative embodiments of the disclosure within a well system 500. The well system 500, in the illustrated embodiment of FIGS. 5A through 5H, additionally includes a coiled tubing deployment/retrieval apparatus 530 designed, manufactured and/or operated according to one or more embodiments of the disclosure. The method, the well system 500 and the coiled tubing deployment/retrieval apparatus 530 of FIGS. 5A through 5H is similar in many respects to the method, well system 300, and coiled tubing deployment/retrieval apparatus 330 of FIGS. 3A through 3F. Accordingly, like reference numbers have been used to indicate similar, if not identical, features. The method, the well system 500 and the coiled tubing deployment/retrieval apparatus 530 of FIGS. 5A through 5H differs, for the most part, from the method, the well system 300 and the coiled tubing deployment/retrieval apparatus 330 of FIGS. 3A through 3F, in that the method, the well system 500 and the coiled tubing deployment/retrieval apparatus 530 of FIGS. 5A through 5H is being used to couple the first coiled tubing string 320 of the first coiled tubing reel 310, which has already been deployed downhole, with a second coiled tubing string 520 of a second coiled tubing reel 510.

Figure 5A:
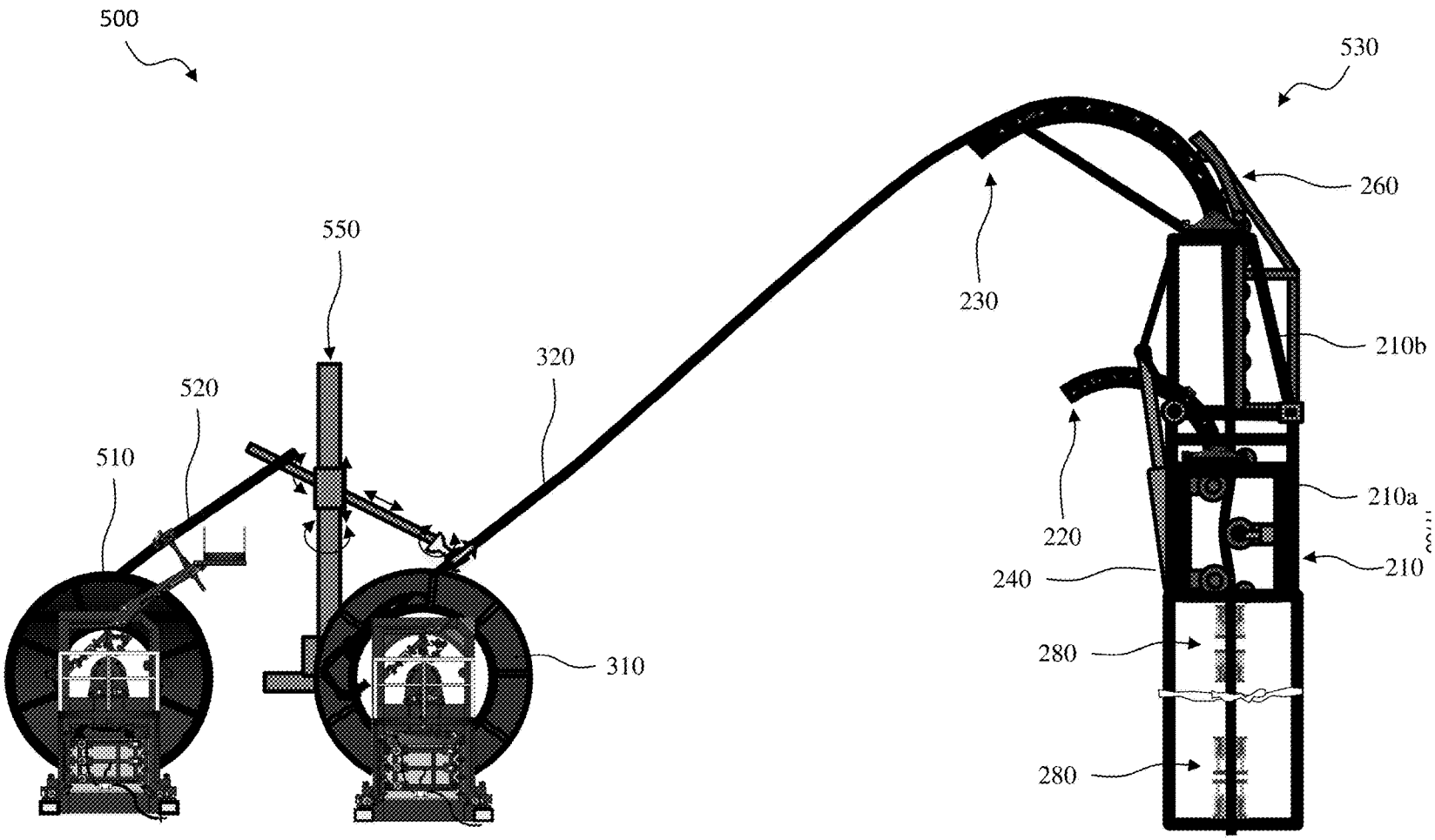
FIGS. 5A through 5H illustrate a method for deploying/retrieving coiled tubing in accordance with one or more alternative embodiments of the disclosure within a well system.

Turning to FIG. 5A, the first coiled tubing string 320 is already positioned over the coiled tubing deployment/retrieval apparatus 530 and within the wellbore. The first coiled tubing string 320 has been run-in-hole until a last remaining portion of the first coiled tubing string 320 is loose at the first coiled tubing reel 310. Thereafter, the uphole end of the first coiled tubing string 320 may be held with a manipulating device 550, such that the uphole end of the first coiled tubing string 320 may be disconnected from the first coiled tubing reel 310. With the uphole end of the first coiled tubing string 320 disconnected from the first coiled tubing reel 310, the manipulating device 550 is free to move the uphole end of the first coiled tubing string 320 as necessary.

Figure 5B:
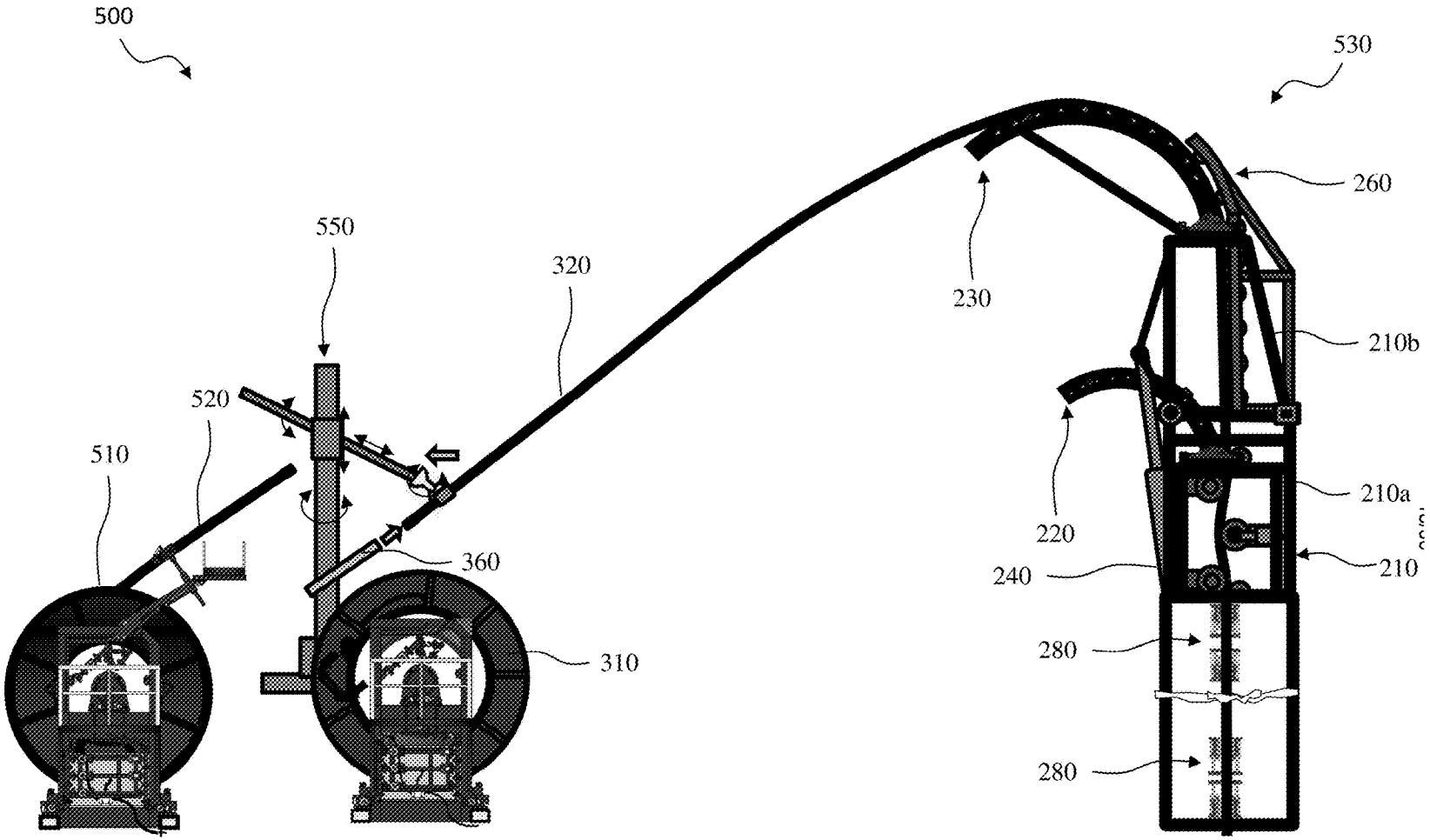

Turning to FIG. 5B, a rigid coil tubing connector 360 may be connected to the uphole end of the first coiled tubing string 320, for example using the manipulating device 550 and other related tools.

Figure 5C:
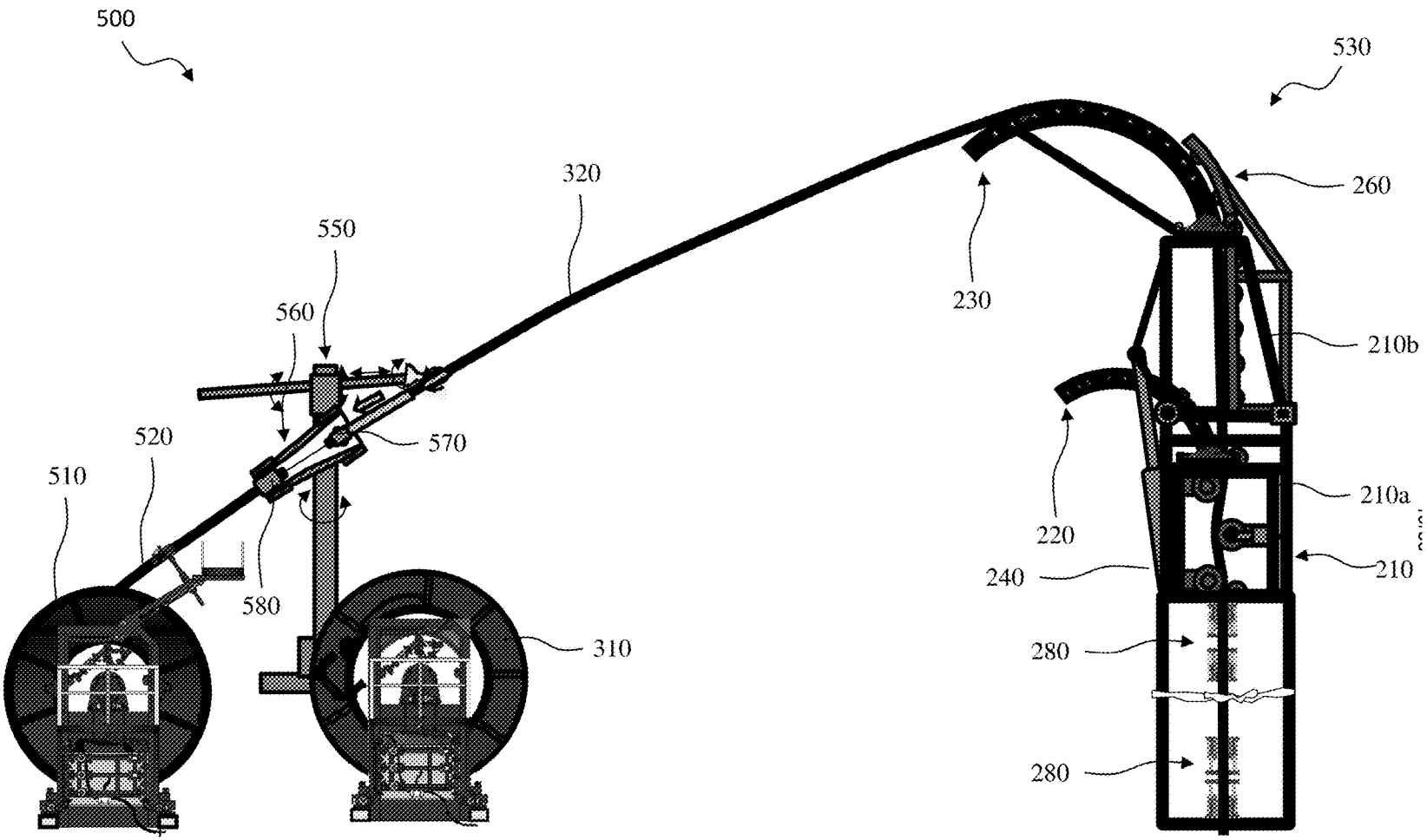

Turning to FIG. 5C, the uphole end of the first coiled tubing string 320 may be coupled with a downhole end of the second coiled tubing string 520 that is wound around the second coiled tubing reel 510, for example using the rigid coil tubing connector 360. In the illustrated embodiment, a coiled tubing alignment apparatus 560 may be used to couple the first and second coiled tubing strings 320, 520. While the details of the coiled tubing alignment apparatus 560 will be discussed in greater detail below, in at least one embodiment a first coiled tubing alignment guide 570 may be coupled to the uphole end of the first coiled tubing string 320 and a second coiled tubing alignment guide 580 may be coupled to the downhole end of the second coiled tubing string 520, and then the coiled tubing alignment apparatus 560 may be used to align the first coiled tubing alignment guide 570 with the second coiled tubing alignment guide 580, and ultimately the uphole end of the first coiled tubing string 320 and the downhole end of the second coiled tubing string 520. As the uphole end of the first coiled tubing string 320 and the downhole end of the second coiled tubing string 520 are brought together via the manipulating device 550 and the associated coiled tubing alignment apparatus 560, the first and second coiled tubing strings 320, 520 temporarily couple together.

Figure 5D:
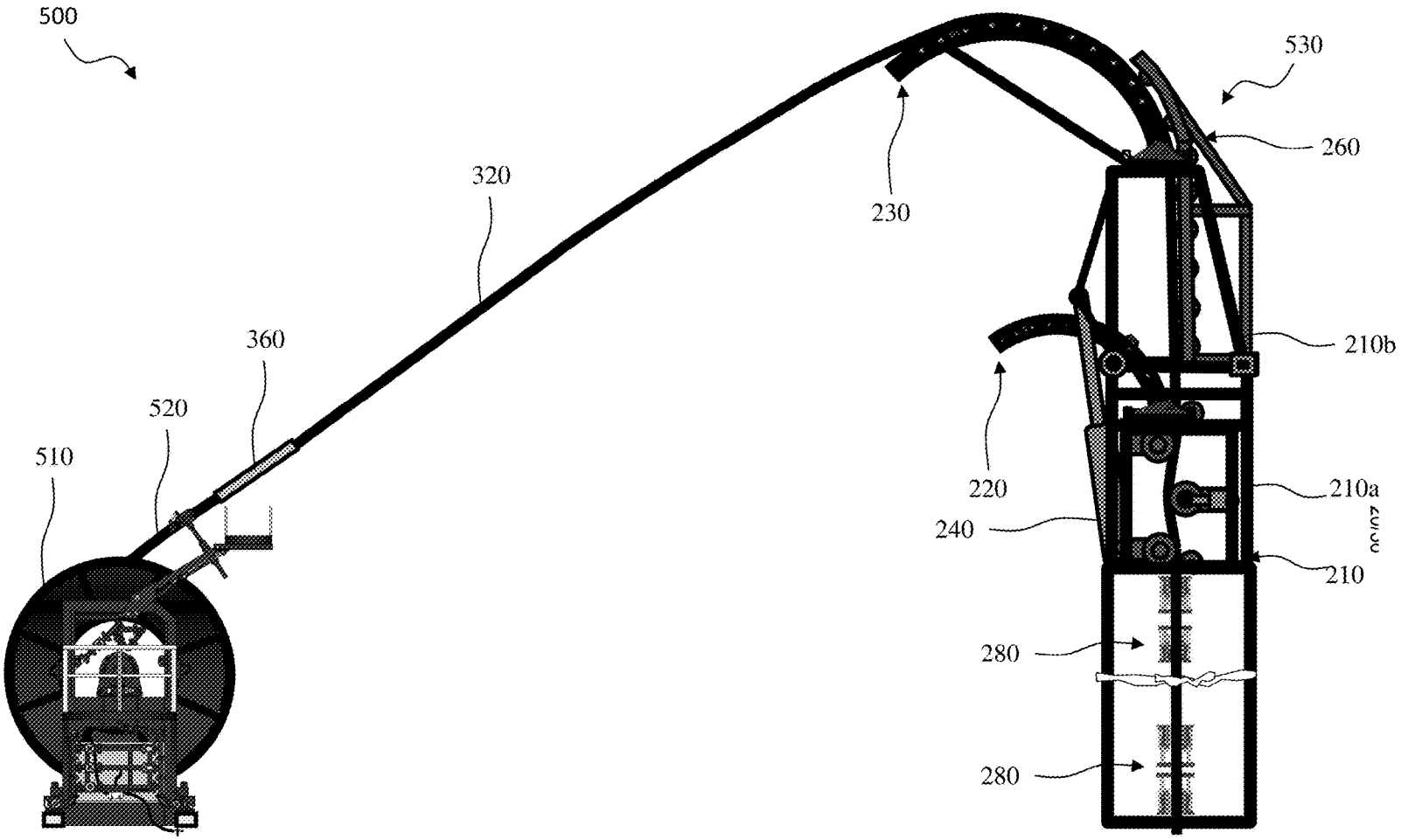
Figure 5E:
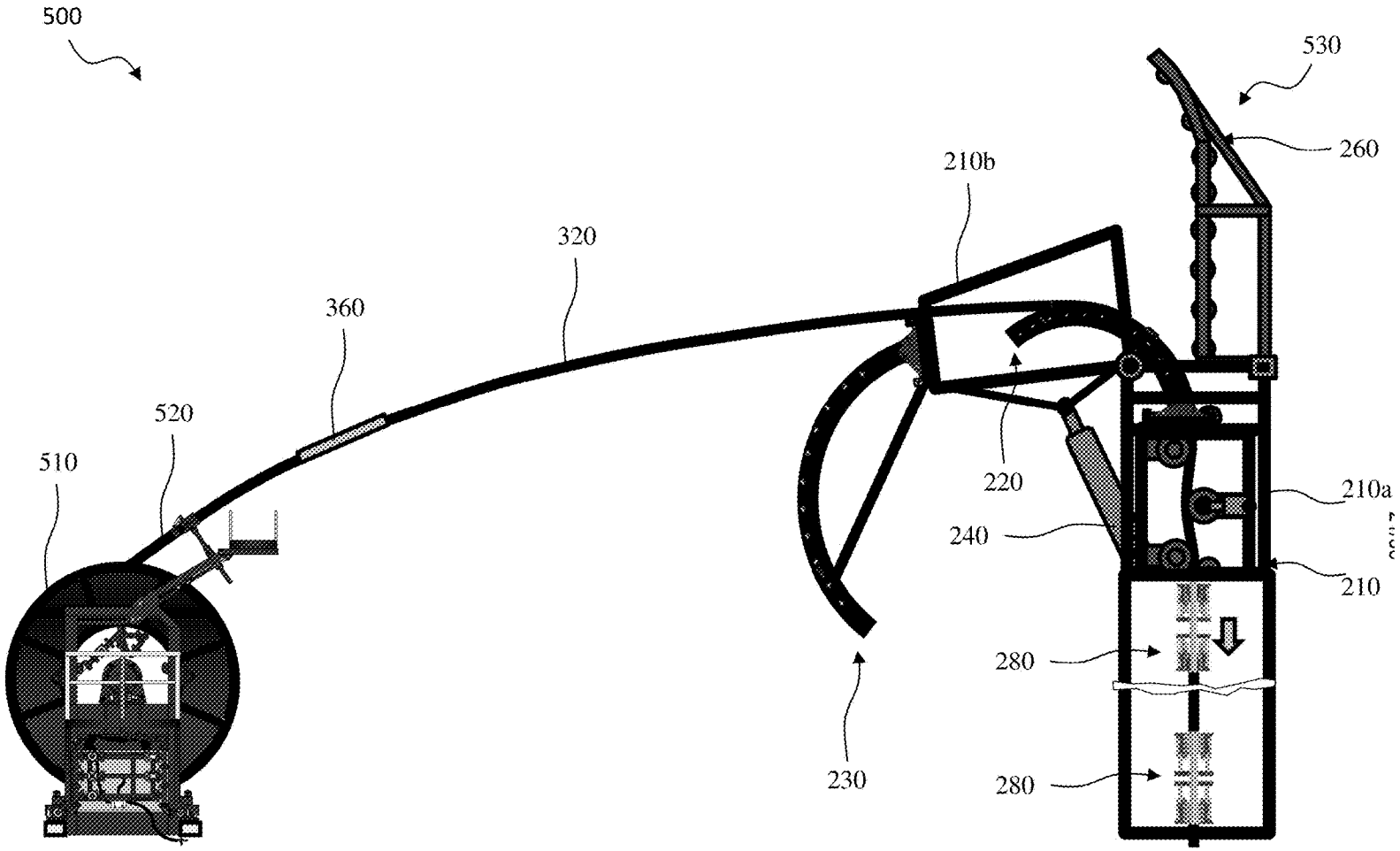
Figure 5F:
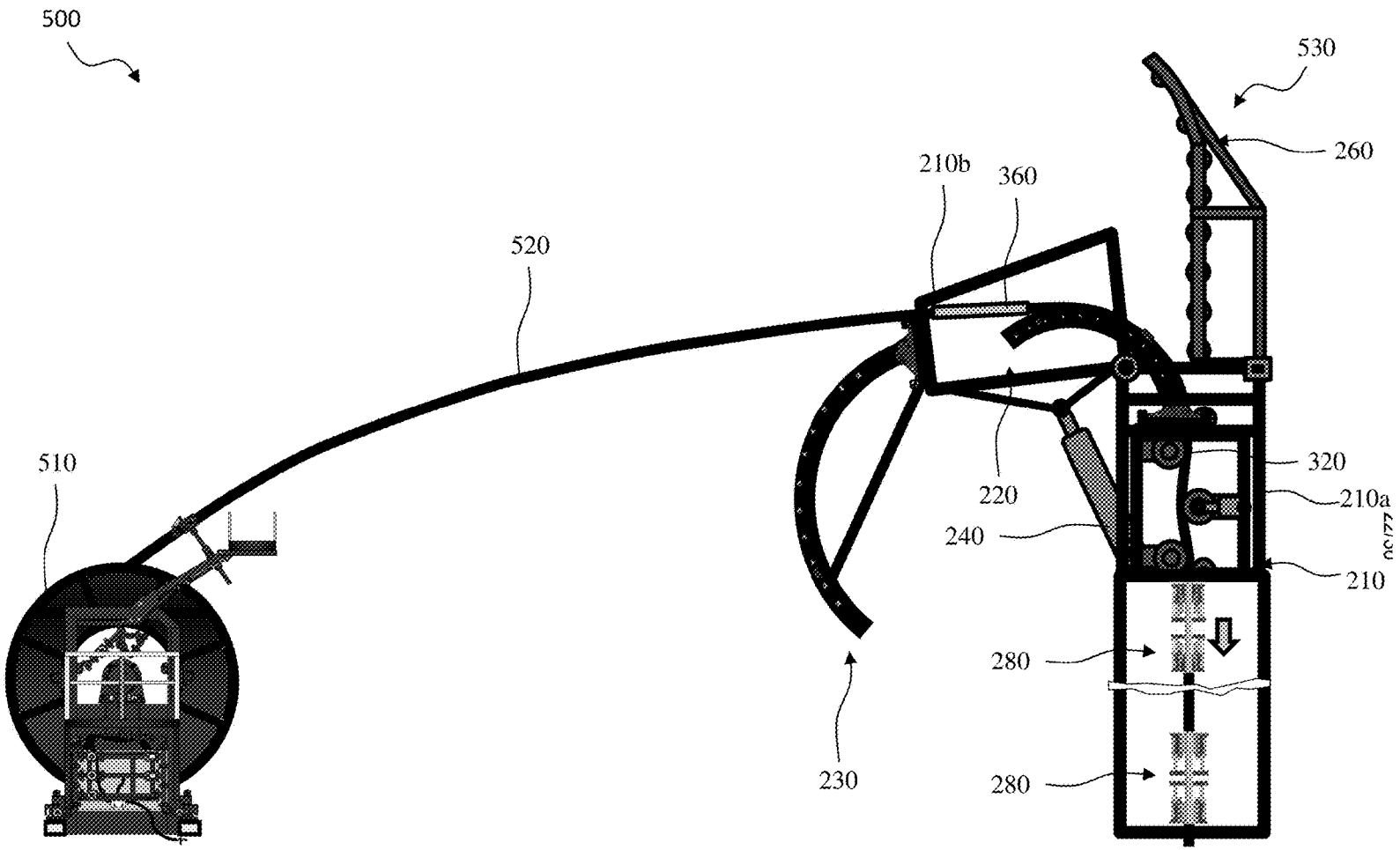
Figure 5G:
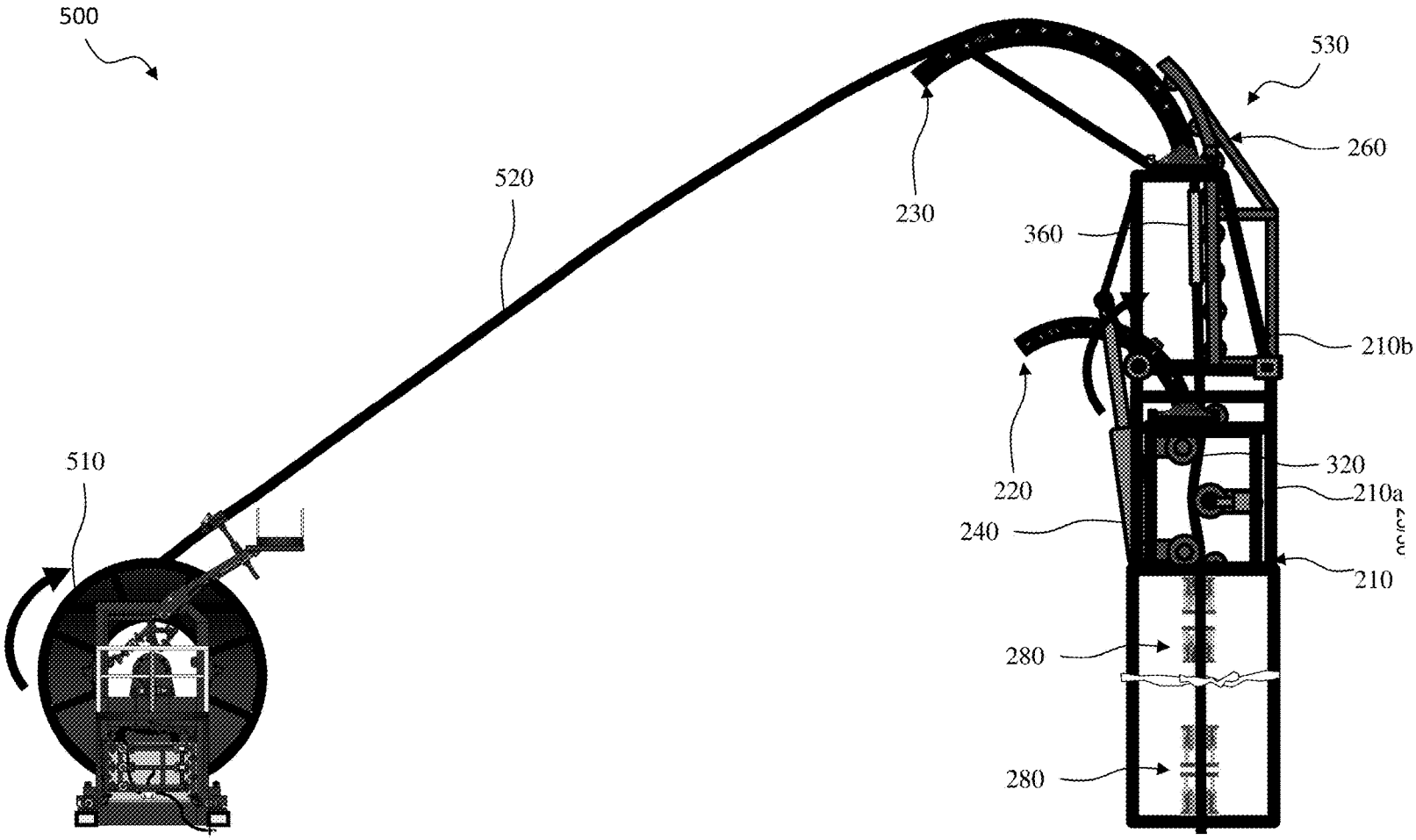
Figure 5H:
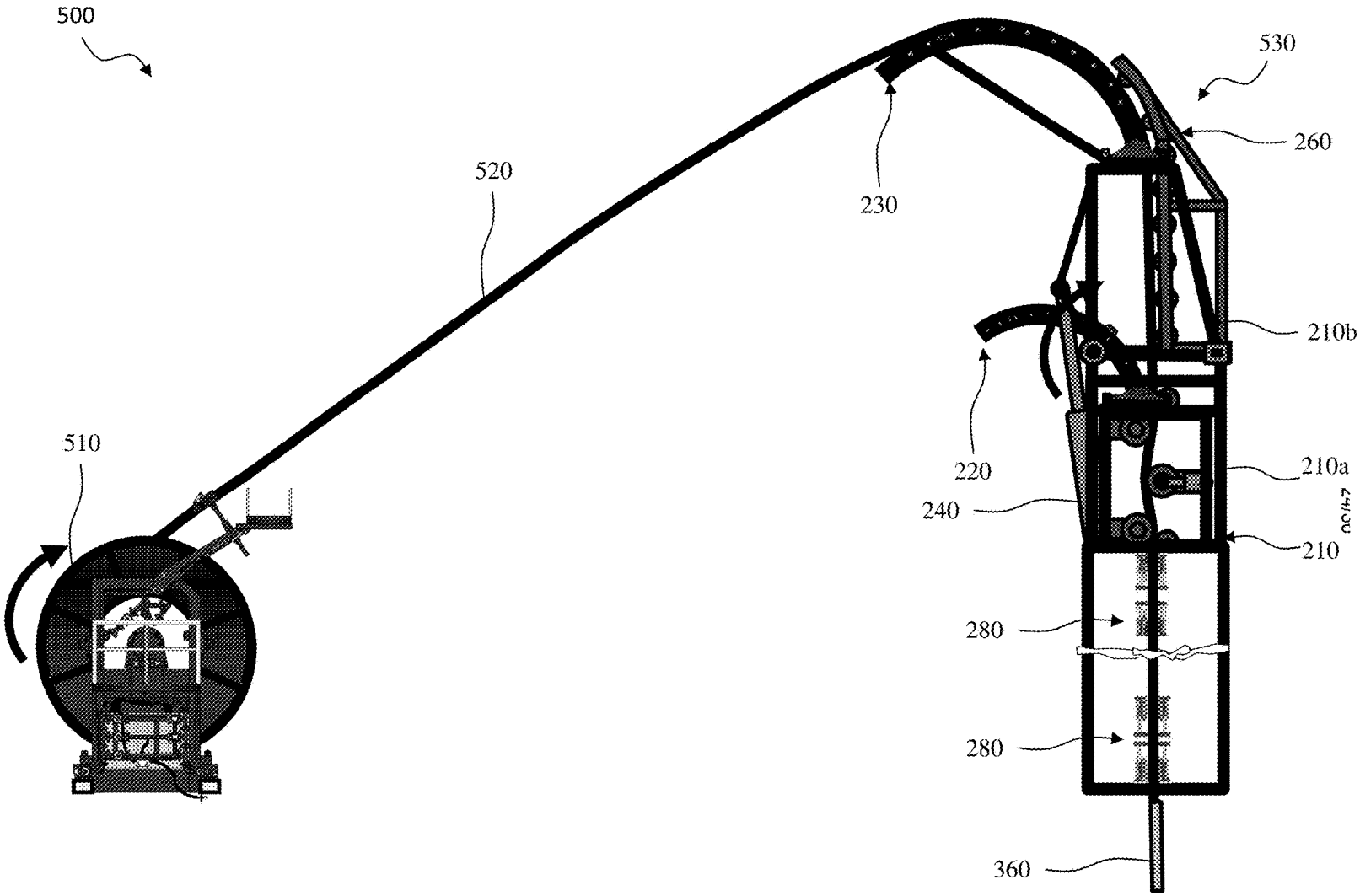

Turning to FIG. 5D, the first coiled tubing alignment guide 570 and the second coiled tubing alignment guide 580 may be removed from their respective coiled tubing strings (e.g., first coiled tubing string 320 and second coiled tubing string 520), and then the connection between the first coiled tubing string 320 and the second coiled tubing string 520 may be finalized. Thereafter, the rigid coil tubing connector 360 may be pressure tested and pull tested. At this stage, the first and second coiled tubing strings 320, 520 now mimic a single continuous coiled tubing string.

Turning now to FIGS. 5E through 5H, the process would continue with the second coiled tubing string 520 and the rigid coil tubing connector 360 in a similar manner as that disclosed above with regard to FIGS. 3C through 3F.

FIGS. 6A through 6F illustrate a method for deploying/retrieving coiled tubing in accordance with one or more alternative embodiments of the disclosure within a well system 600. The well system 600, in the illustrated embodiment of FIGS. 6A through 6F, additionally includes a coiled tubing deployment/retrieval apparatus 630 designed, manufactured and/or operated according to one or more embodiments of the disclosure. The method, the well system 600 and the coiled tubing deployment/retrieval apparatus 630 of FIGS. 6A through 6F is similar in many respects to the method, well system 300, and coiled tubing deployment/retrieval apparatus 330 of FIGS. 3A through 3F. Accordingly, like reference numbers have been used to indicate similar, if not identical, features. The method, the well system 600 and the coiled tubing deployment/retrieval apparatus 630 of FIGS. 6A through 6F differs, for the most part, from the method, the well system 300 and the coiled tubing deployment/retrieval apparatus 330 of FIGS. 3A through 3F, in that the method, the well system 600 and the coiled tubing deployment/retrieval apparatus 630 of FIGS. 6A through 6C employs a coiled tubing alignment apparatus 640 designed, manufactured and/or operated according to one or more embodiments of the disclosure.

The coiled tubing alignment apparatus 640, in one or more embodiments, includes a first alignment housing 650, the first alignment housing 650 having a first angled portion 652 and a first straight portion 654. The coiled tubing alignment apparatus 640, in one or more embodiments, further includes a second alignment housing 660, the second alignment housing 660 having a second angled portion 662 and second straight portion 664. In one or more embodiments, the first alignment housing 650 and the second alignment housing 660 are configured to move between a first state having the first and second alignment housings 650, 660 separated from one another (e.g., as shown in FIGS. 6A, 6B, 6E and 6F) and a second state having the first and second alignment housings 650, 660 coupled to one another (e.g., as shown in FIGS. 6C and 6D). In at least one embodiment, when the first and second alignment housings 650, 660 are in the second state, they are coupled to one another to form an alignment cone 670 and an alignment cylinder 675.

In at least one other embodiment, the coiled tubing alignment apparatus 640 includes a third alignment housing (e.g., fourth alignment housing, fifth alignment housing, etc.), the third alignment housing having a third angled portion and a third straight portion. In this embodiment, the second state has the first, second and third alignment housings coupled to one another to form the alignment cone 670 and the alignment cylinder 675.

In at least one embodiment, the coiled tubing alignment apparatus 640 further includes a deployment mechanism 680 for moving the first alignment housing 650 and the second alignment housing 660 between the first state and the second state. For example, in at least one embodiment, the deployment mechanism 680 axially moves the first alignment housing 650 and the second alignment housing 660 between a radially outward state (e.g., first state) and a radially inward state (e.g., second state). In at least one embodiment, the deployment mechanism 680 is a hydraulic deployment mechanism. In yet another embodiment, the deployment mechanism 680 is an electric deployment mechanism. In even yet another embodiment, the deployment mechanism 680 is a mechanical deployment mechanism.

As shown in the embodiment of FIGS. 6A through 6F, a coiled tubing alignment guide 690 may be attached to an end of the coiled tubing string 320, for example to align the coiled tubing string 320 within the alignment cone 670 and the alignment cylinder 675 when the first and second alignment housings 650, 660 are in the second state. As further shown in the embodiment of FIGS. 6A through 6F, a bottom hole assembly alignment guide 695 may be attached to an end of the bottom hole assembly 625, for example to align the bottom hole assembly 625 within the alignment cone 670 and the alignment cylinder 675 when the first and second alignment housings 650, 660 are in the second state.

Figure 6A:
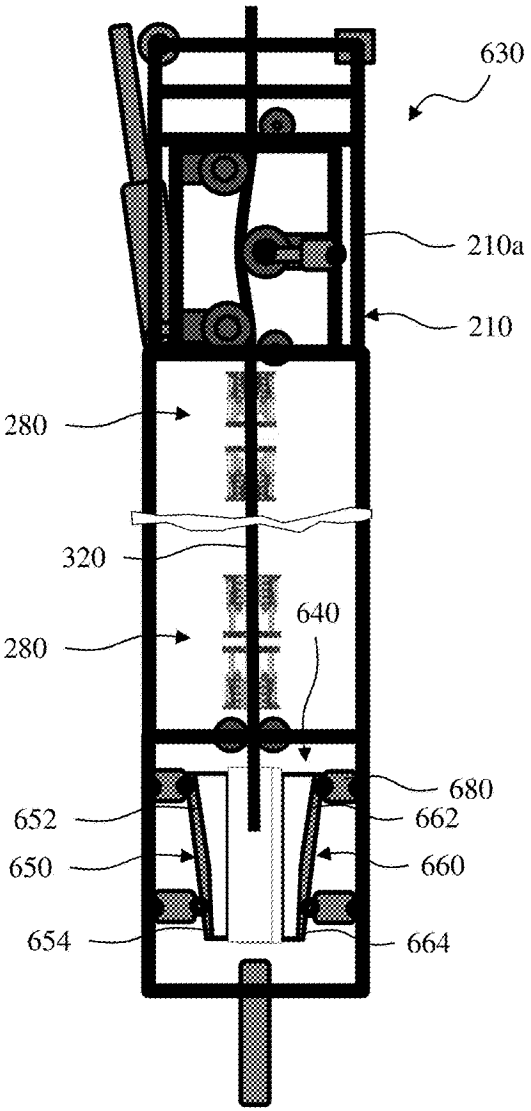
FIGS. 6A through 6F illustrate a method for deploying/retrieving coiled tubing in accordance with one or more alternative embodiments of the disclosure within a well system.

Turning to FIG. 6A, the coiled tubing deployment/retrieval apparatus 630 is illustrated with a downhole end of the coiled tubing string 320 positioned below the travelling/stationary slips 280 and spaced a short distance apart from the bottom hole assembly 625. Furthermore, at this stage, the first and second alignment housings 650, 660 are in the first state (e.g., radially outward state).

Figure 6B:
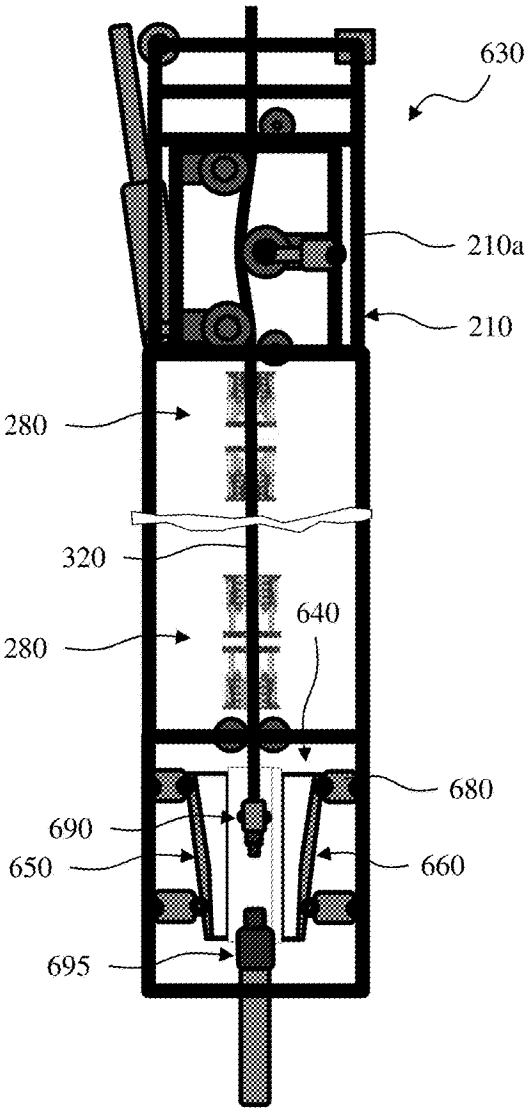
Figure 6C:
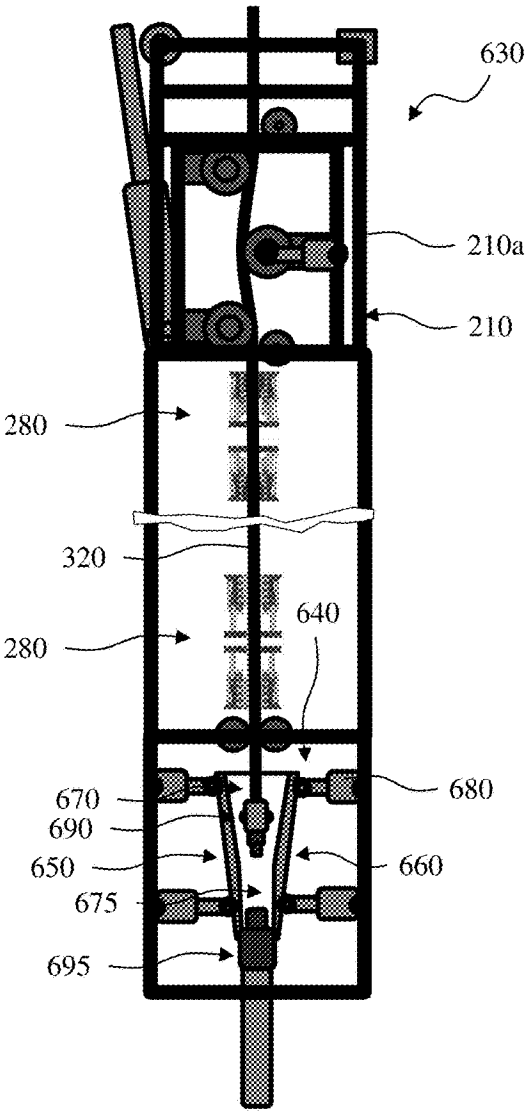
Figure 6D:
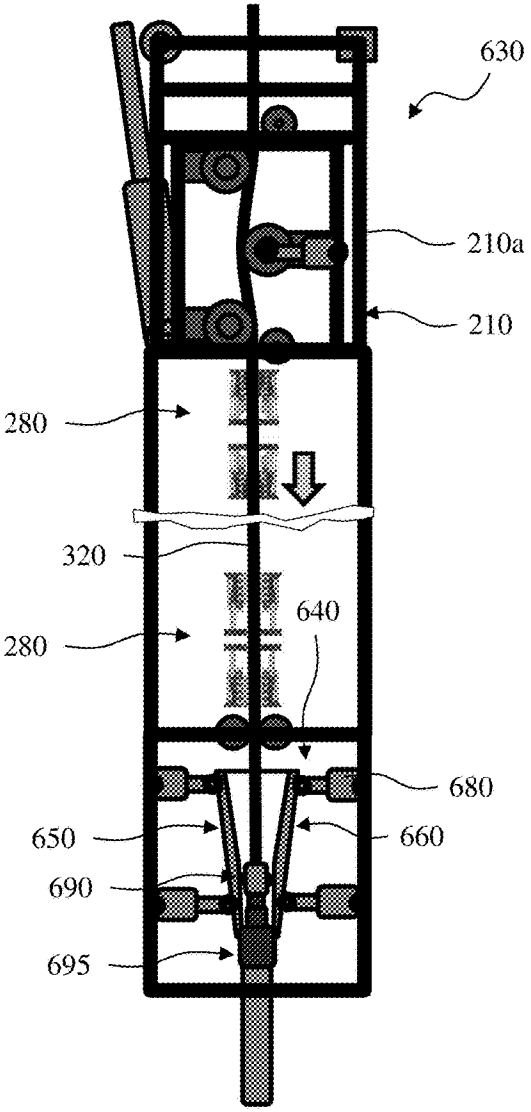

Turning to FIG. 6B, the coiled tubing alignment guide 690 and the bottom hole assembly alignment guide 695 may be coupled to ends of the coiled tubing string 320 and the bottom hole assembly 625. Again, at this stage the first and second alignment housings 650, 660 are in the first state (e.g., radially outward state).

Turning to FIG. 6C, the first and second alignment housings 650, 660 are moved to the second state (e.g., radially inward state) via the deployment mechanism 680.

Turning to FIG. 6D, the travelling/stationary slips 280 are activated to bring the coiled tubing string 320 toward the bottom hole assembly 625. In this embodiment, the coiled tubing alignment guide 690 first engages with the alignment cone 670, and then the alignment cylinder 675, to align the coiled tubing string 320 with the bottom hole assembly 625. As the coiled tubing string 320 engages the bottom hole assembly 625, they may temporarily couple together (e.g., snap together).

Figure 6E:
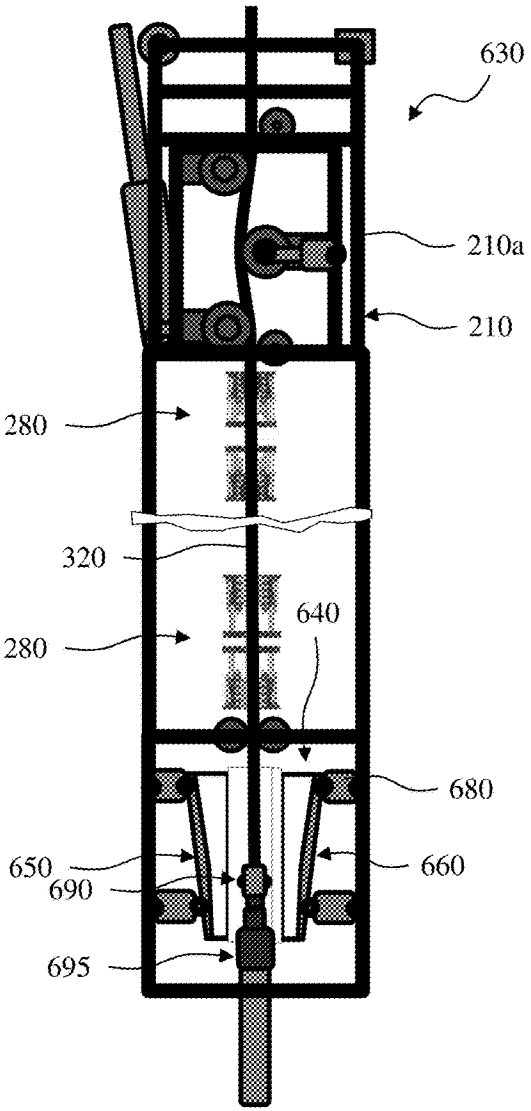

Turning to FIG. 6E, the first and second alignment housings 650, 660 are moved back to the first state (e.g., radially outward state) via the deployment mechanism 680.

Figure 6F:
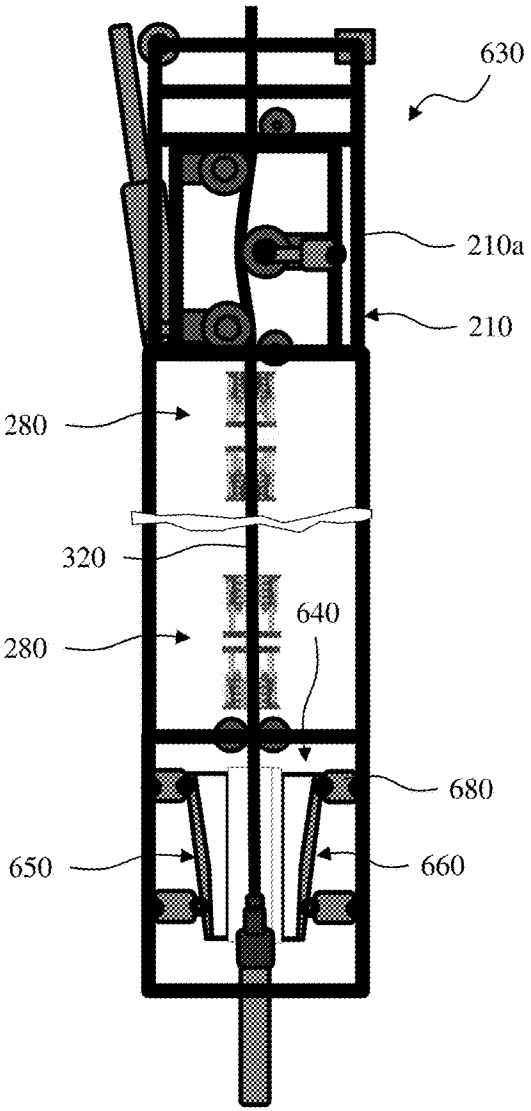

Turning to FIG. 6F, the coiled tubing alignment guide 690 is removed from the coiled tubing string 320, and then the connection between the coiled tubing string 320 and the bottom hole assembly 625 may be finalized. Thereafter, the coiled tubing string 320 and the bottom hole assembly 625 may be pressure tested and pull tested. At this stage, the coiled tubing string 320 and the bottom hole assembly 625 are ready for continued use.

Figure 7A:
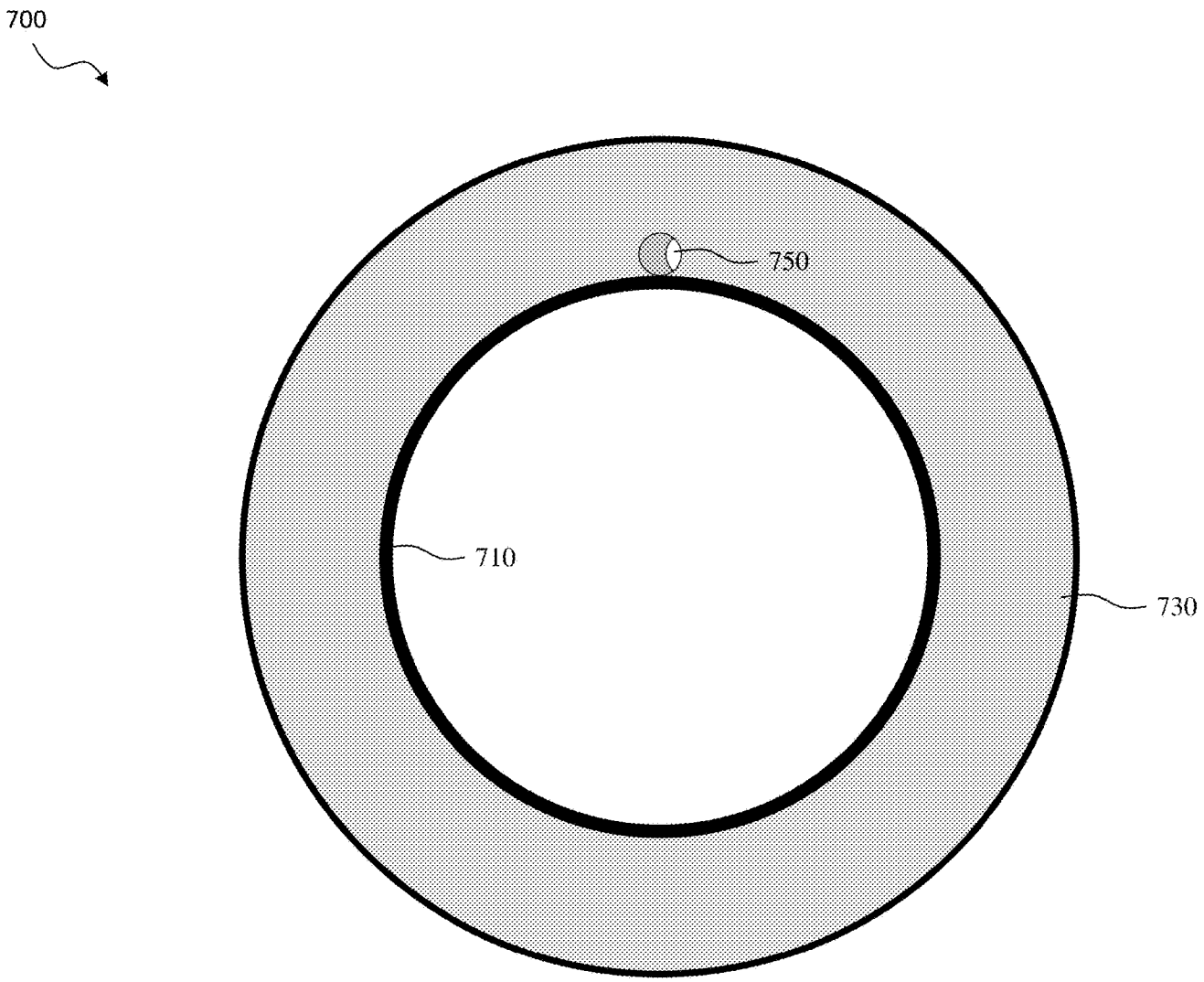
FIGS. 7A and 7B illustrate various different views of a coiled tubing reel designed, manufactured and/or operated according to one or more embodiments of the disclosure, and as might be used with a well system, such as the well systems described herein.
Figure 7B:
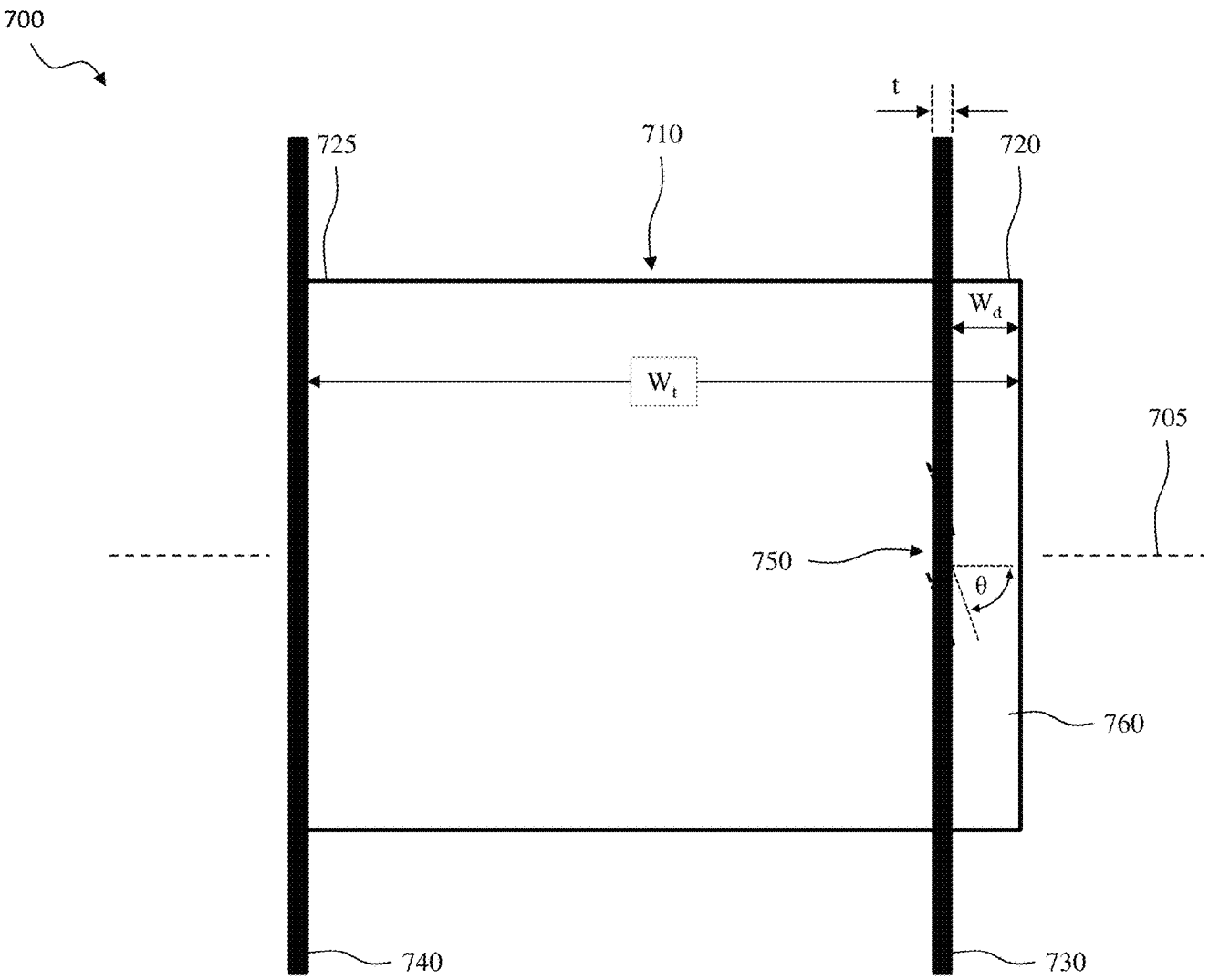

Turning now to FIGS. 7A and 7B, illustrated are various different views of a coiled tubing reel 700 designed, manufactured and/or operated according to one or more embodiments of the disclosure, and as might be used with a well system, such as the well systems 100, 300, 400, 500, 600 described above. The coiled tubing reel 700, in the illustrated embodiment, includes a drum 710 having a first end 720 and a second end 725. In one or more embodiments, first and second flanges 730, 740 are coupled to the drum 710. In at least one embodiment, the first and second flanges 730, 740 are configured to radially support a coiled tubing string wound upon the drum 710.

In accordance with one or more embodiments of the disclosure, the coiled tubing reel 700 includes a coiled tubing exit opening 750 extending through a sidewall thickness (t) of the first flange 730. In one or more embodiments, the coiled tubing exit opening 750 extends through the sidewall thickness (t) of the first flange 730 proximate a junction wherein the first flange 730 couples to the drum 710. In accordance with one or more embodiments, the coiled tubing exit opening 750 is configured to allow a radially interior end of the coiled tubing string to exit the first flange 730 at a reduced angle, to avoid or minimize bending of the coiled tubing string along a certain length at the coiled tubing string end. This is in contrast to traditional coiled tubing reel designs, wherein the coiled tubing exit opening extends directly through the drum itself, for example between the first and second flanges, which requires substantial additional bending of the coiled tubing string end portions for the string installation/connection inside the drum 710 and results in significant additional bending of the coiled tubing string along its end length and a large residual/permanent string bend curvature at the string end.

In accordance with one or more embodiments, the coiled tubing exit opening 750 extends through the sidewall thickness (t) to allow the coiled tubing string to exit the reel at an angle (0) that is not parallel with nor perpendicular to an axis of rotation 705 of the coiled tubing reel 700. For example, in one or more embodiments, the angle (0) ranges from 30 degrees to 89 degrees relative to the axis of rotation 705 of the coiled tubing reel 700, from 45 degrees to 89 degrees relative to the axis of rotation 705 of the coiled tubing reel 700, or from 60 degrees to 89 degrees relative to the axis of rotation 705 of the coiled tubing reel 700.

In the illustrated embodiment of FIGS. 7A and 7B, the first and second flanges 730, 740 are coupled to the drum proximate the first end 720 and the second end 725, the first flange 730 forming an exposed drum portion 760. The term "proximate" as used herein relating to the exposed drum portion 760, means that the exposed drum portion 760 has a width ($W_d$) of less than 50 percent a total width ($W_t$) of the drum 710. In yet another embodiment, however, the exposed drum portion 760 has a width ($W_d$) of less than 25 percent a total width ($W_t$) of the drum 710, if not less than 10 percent a total width ($W_t$) of the drum 710.

Turning now to FIGS. 8A and 8B, illustrated are various different views of a coiled tubing reel 800 designed, manufactured and/or operated according to one or more alternative embodiments of the disclosure, and as might be used with a well system, such as the well systems 100, 300, 400, 500, 600 described above. The coiled tubing reel 800 of FIGS. 8A and 8B is similar in many respects to the coiled tubing reel 700 of FIGS. 7A and 7B. Accordingly, like reference numbers have been used to indicate similar, if not identical, features. The coiled tubing reel 800 differs from the coil tubing reel 700, for the most part, in that the coiled tubing reel 800 includes a coiled tubing clamping apparatus 810 coupled to the exposed drum portion 760. In at least one embodiment, the coiled tubing clamping apparatus 810 is coupled to the exposed drum portion 760 proximate the coiled tubing exit opening 750, and is configured to fix the radially interior end of the coiled tubing string to the coiled tubing reel 710.

In at least one embodiment, the coiled tubing reel 800 further includes a rigid coiled tubing connector 820 having a first end 830 and a second end 835. In one or more embodiments, the first end 830 of the rigid coiled tubing connector 820 is aligned with the coiled tubing clamping apparatus 810, and the second end 835 of the rigid coiled tubing connector 820 extends through the exposed drum portion 760 and into an interior of the drum 710. In at least one embodiment, at least a portion of the rigid coiled tubing connector 820 is a 1502 coiled tubing connector.

The coiled tubing clamping apparatus 810, in one or more embodiments, also acts as a guide for the coiled tubing string end to engage with other features. For example, the coiled tubing clamping apparatus 810 may guide the coiled tubing string end into engagement with the rigid coiled tubing connector 820. Moreover, the addition of the rigid coiled tubing connector 820 provides many benefits. For example, using the rigid coiled tubing connector 820 means that there is no need to further bend the coiled tubing string into the drum 710. Additionally, the rigid coiled tubing connector 820 allows for a much straighter coiled tubing string end section and easier coiled tubing string installation. Additionally, it provides much better access for easier positioning of the coiled tubing string end and connection to the 1502 connector, as well as disconnection from the 1502 connector. Moreover, using the rigid coiled tubing connector 820 means that there is little need to work inside of the drum 710.

Turning now to FIGS. 9A and 9B, illustrated are various different views of a coiled tubing reel 900 designed, manufactured and/or operated according to one or more alternative embodiments of the disclosure, and as might be used with a well system, such as the well systems 100, 300, 400, 500, 600 described above. The coiled tubing reel 900 of FIGS. 9A and 98B is similar in many respects to the coiled tubing reel 800 of FIGS. 8A and 8B. Accordingly, like reference numbers have been used to indicate similar, if not identical, features. The coiled tubing reel 900 differs from the coil tubing reel 800, for the most part, in that the coiled tubing reel 900 includes a coiled tubing string 910 wound upon the drum 710. Additionally, the uphole end of the coiled tubing string 910 extends through a coiled tubing exit opening 950, and thereafter couples with the rigid coiled tubing connector 820. Additionally, the coiled tubing clamping apparatus 810 fixes the uphole end of the coiled tubing string 910 relative to the drum 710.

Further to the embodiment of FIGS. 9A and 9B, the coiled tubing exit opening 950 is not an angled smaller coiled tubing exit opening (e.g., angled circular coiled tubing opening), but in turn is a larger (e.g., non-angled) coiled tubing exit opening, as shown. For example, in accordance with one or more other embodiments, a cross-sectional surface area of the coiled tubing exit opening 950 is at least three times a cross-sectional surface area of the coiled tubing string 910, for example to allow the radially interior end of the coiled tubing string 910 to exit the first flange 730 at a reduced angle (β). In yet another embodiment, a cross-sectional surface area of the coiled tubing exit opening 950 is at least six times a cross-sectional surface area of the coiled tubing string 910, for example to allow the radially interior end of the coiled tubing string 910 to exit the first flange 730 at the reduced angle (β). In even yet another embodiment, a cross-sectional surface area of the coiled tubing exit opening 950 is at least fifteen times a cross-sectional surface area of the coiled tubing string 910, for example to allow the radially interior end of the coiled tubing string 910 to exit the first flange 730 at the reduced angle (β).

Given the larger coiled tubing exit opening 950, the coiled tubing string 910 may exit the first flange 730 at the reduced angle (β). In one or more embodiments, the reduced angle (β) is at least 45 degrees, if not at least 50 degrees, if not at least 55 degrees, if not at least 60 degrees, if not at least 65 degrees, if not at least 70, degrees if not at least 75 degrees, if not at least 80 degrees, if not at least 85 degrees, if not at least 88 degrees, all of which are relative to the axis of rotation 705.

Aspects disclosed herein include:

A. A coiled tubing deployment/retrieval apparatus, the coiled tubing deployment/retrieval apparatus including: 1) a frame; 2) a lower tubing guide coupled to the frame; and 3) an upper tubing guide coupled to the frame, the upper tubing guide configured to move between a primary position and a secondary position relative to the lower tubing guide, the secondary position configured to allow a rigid connector of a coiled tubing string to at least partially bypass the upper tubing guide.

B. A method for deploying/retrieving coiled tubing, the method including: 1) providing a coiled tubing deployment/retrieval apparatus, the coiled tubing deployment/retrieval apparatus including: a) a frame; b) a lower tubing guide coupled to the frame; and c) an upper tubing guide coupled to the frame, the upper tubing guide configured to move between a primary position and a secondary position relative to the lower tubing guide, the secondary position configured to allow a rigid connector of a coiled tubing string to at least partially bypass the upper tubing guide; 2) coupling a rigid connector of a coiled tubing string to another string at a first location outside of the coiled tubing deployment/retrieval apparatus; 3) moving the upper tubing guide from the primary position to the secondary position; 4) pulling the rigid connector into the coiled tubing deployment/retrieval apparatus and past the upper tubing guide located in the secondary position; and 5) moving the upper tubing guide from the secondary position to the primary position with the rigid connector in the coiled tubing deployment/retrieval apparatus and past the upper tubing guide.

C. A well system, the well system including: 1) a wellbore extending through one or more subterranean formations; and 2) a coiled tubing deployment/retrieval apparatus positioned over the wellbore, the coiled tubing deployment/retrieval apparatus including: a) a frame; b) a lower tubing guide coupled to the frame; and c) an upper tubing guide coupled to the frame, the upper tubing guide configured to move between a primary position and a secondary position relative to the lower tubing guide, the secondary position configured to allow a rigid connector of a coiled tubing string to at least partially bypass the upper tubing guide.

D. A coiled tubing alignment apparatus, the coiled tubing alignment apparatus including: 1) a first alignment housing, the first alignment housing having a first angled portion and a first straight portion; and 2) a second alignment housing, the second alignment housing having a second angled portion and second straight portion, wherein the first alignment housing and the second alignment housing are configured to move between a first state having the first and second alignment housings separated from one another and a second state having the first and second alignment housings coupled to one another to form an alignment cone and an alignment cylinder.

E. A method for deploying/retrieving coiled tubing, the method including: 1) providing a coiled tubing alignment apparatus, the coiled tubing alignment apparatus including: a) a first alignment housing, the first alignment housing having a first angled portion and a first straight portion; and b) a second alignment housing, the second alignment housing having a second angled portion and second straight portion, wherein the first alignment housing and the second alignment housing are configured to move between a first state having the first and second alignment housings separated from one another and a second state having the first and second alignment housings coupled to one another to form an alignment cone and an alignment cylinder; 2) feeding coiled tubing string through the alignment cone and the alignment cylinder of the coiled tubing alignment apparatus that is formed when the first and second alignment housings are positioned in the second state; 3) coupling the coiled tubing string with other tubing while the first and second alignment housings are positioned in the second state; and 4) moving the first and second alignment housings from the second state to the first state after coupling the coiled tubing string with the other tubing.

F. A coiled tubing reel, the coiled tubing reel including: 1) a drum having a first end and a second end; 2) first and second flanges coupled to the drum, the first and second flanges configured to radially support a coiled tubing string wound upon the drum; and 3) a coiled tubing exit opening extending through a sidewall thickness (t) of the first flange proximate a junction wherein the first flange couples to the drum, the coiled tubing exit opening configured to allow a radially interior end of the coiled tubing string to exit the first flange at a reduced angle.

G. A method for connecting an end of coiled tubing string to a coiled tubing reel, the method including: 1) positioning the coiled tubing string end through an exit opening extending through a sidewall thickness (t) of the first reel flange proximate a junction wherein the first flange couples to the drum, the coiled tubing exit opening configured to allow a radially interior end of the coiled tubing string to exit the first flange at a reduced angle; and 2) clamping the end of the coiled tubing string to the exterior side of the reel drum.

H. A method, the method including: 1) providing a coiled tubing reel, the coiled tubing reel including: a) a drum having a first end and a second end; b) first and second flanges coupled to the drum, the first and second flanges configured to axially and radially support a coiled tubing string wound upon the drum; and c) a coiled tubing exit opening extending through a sidewall thickness (t) of the first flange proximate a junction wherein the first flange couples to the drum; 2) feeding a radially interior end of a coiled tubing string through the coiled tubing exit opening at a reduced angle (β); and 3) rotating the coiled tubing reel with the radial interior end of the coiled tubing string fed through the coiled tubing exit opening about its axis of rotation to wind the coiling tubing string about the coiled tubing reel.

I. A method for connecting an end of coiled tubing string to a coiled tubing reel, the method including: 1) positioning a radially interior end of a coiled tubing string through a coiled tubing exit opening extending through a sidewall thickness (t) of a first flange proximate a junction wherein the first flange couples to a drum, the coiled tubing exit opening configured to allow the radially interior end of the coiled tubing string to exit the first flange at a reduced angle (β) relative to an axis of rotation of the drum; and 2) clamping the radially interior end of the coiled tubing string that is extending out the first flange to an exterior side of the drum.

Aspects A, B, C, D, E, F, G, H and I may have one or more of the following additional elements in combination: Element 1: wherein the upper tubing guide is configured to rotate between the primary position and the secondary position relative to the lower tubing guide. Element 2: wherein the frame includes a lower frame portion and an upper frame portion rotationally coupled to the lower frame portion about a rotation point, the lower tubing guide coupled to the lower frame portion and the upper tubing guide coupled to the upper frame portion, the rotation point allowing the upper tubing guide to rotate between the primary position and the secondary position relative to the lower tubing guide. Element 3: further including a telescoping cylinder positioned between the lower frame portion and the upper frame portion, the telescoping cylinder configured to move the upper tubing guide between the primary position and the secondary position. Element 4: wherein telescoping cylinder is a hydraulic cylinder or electric cylinder. Element 5: wherein the upper frame portion has a height ($h_{UF}$), and further wherein the height ($h_{UF}$) is great enough to allow ample space for the rigid connector to reside between the lower tubing guide and the upper tubing guide when the upper tubing guide is in the secondary position. Element 6: wherein the lower tubing guide has a height ($h_L$), and further wherein a totality of the upper tubing guide is located below the height ($h_L$) of the lower tubing guide when the upper tubing guide is in its secondary position relative to the lower tubing guide. Element 7: wherein the lower tubing guide has a first radius of curvature ($R_{LG}$) and the upper tubing guide has a second different radius of curvature ($R_{UG}$). Element 8: wherein the first radius of curvature ($R_{LG}$) is less than the second different radius of curvature ($R_{UG}$). Element 9: wherein each of the upper tubing guide and the lower tubing guide include a plurality of rollers for guiding coiled tubing string. Element 10: wherein the moving includes rotating the upper tubing guide from the primary position to the secondary position. Element 11: wherein the lower tubing guide has a first radius of curvature ($R_{LG}$) and the upper tubing guide has a second different radius of curvature ($R_{UG}$), and further wherein the first radius of curvature ($R_{LG}$) is less than the second different radius of curvature ($R_{UG}$). Element 12: wherein the coiled tubing string is a first coiled tubing string and the another string is a second coiled tubing string. Element 13: further including a third alignment housing, the third alignment housing having a third angled portion and a third straight portion. Element 14: wherein the second state has the first, second and third alignment housings coupled to one another to form the alignment cone and the alignment cylinder. Element 15: further including a deployment mechanism for moving the first alignment housing and the second alignment housing between the first state and the second state. Element 16: wherein the deployment mechanism axially moves the first alignment housing and the second alignment housing between a radially outward state and a radially inward state. Element 17: wherein the deployment mechanism is a hydraulic deployment mechanism. Element 18: wherein the deployment mechanism is an electric deployment mechanism. Element 19: wherein the deployment mechanism is a mechanical deployment mechanism. Element 20: further including a coiled tubing alignment guide, the coiled tubing alignment guide configured to attach to an end of coiled tubing to align the coiled tubing string within the alignment cone and the alignment cylinder. Element 21: further including a bottom hole assembly alignment guide, the bottom hole assembly alignment guide configured to attach to an end of a bottom hole assembly to align the bottom hole assembly within the alignment cylinder. Element 22: further including attaching a coiled tubing alignment guide to an end of the coiled tubing string while the first and second alignment housings are in the first state and prior to feeding the coiled tubing string through the alignment cone and the alignment cylinder. Element 23: wherein the other tubing is a bottom hole assembly, and further including attaching a bottom hole assembly alignment guide to an end of the bottom hole assembly while the first and second alignment housings are in the first state and prior to feeding the coiled tubing string through the alignment cone and the alignment cylinder. Element 24: wherein feeding the coiled tubing string through the alignment cone and the alignment cylinder has the coiled tubing alignment guide first ride upon the alignment cone and then ride upon the alignment cylinder to align the coiled tubing string with the bottom hole assembly prior to coupling the coiled tubing string with the bottom hole assembly. Element 25: wherein the coupling is initially coupling and further including securing the coiled tubing string to the bottom hole assembly using a mechanical fastener after moving the first and second alignment housings from the second state to the first state. Element 26: wherein the other tubing is a second coiled tubing string, and further including attaching a second coiled tubing alignment guide to an end of the second coiled tubing string while the first and second alignment housings are in the first state and prior to feeding the coiled tubing string through the alignment cone and the alignment cylinder. Element 27: wherein feeding the coiled tubing string through the alignment cone and the alignment cylinder has the coiled tubing alignment guide first ride upon the alignment cone and then ride upon the alignment cylinder to align the coiled tubing string with the second coiled tubing string prior to coupling the coiled tubing string with the second coiled tubing string. Element 28: wherein the coupling is initially coupling and further including securing the coiled tubing string to the second coiled tubing string using a mechanical fastener after moving the first and second alignment housings from the second state to the first state. Element 29: further including a deployment mechanism for moving the first alignment housing and the second alignment housing between the first state and the second state. Element 30: wherein the deployment mechanism axially moves the first alignment housing and the second alignment housing between a radially outward state and a radially inward state. Element 31: wherein the coiled tubing exit opening extends through the sidewall thickness (t) at an angle (θ) that is not parallel with nor perpendicular to an axis of rotation of the coiled tubing reel. Element 32: wherein the angle (θ) ranges from 30 degrees to 89 degrees relative to the axis of rotation of the coiled tubing reel. Element 33: wherein the angle (θ) ranges from 45 degrees to 89 degrees relative to the axis of rotation of the coiled tubing reel. Element 34: wherein the angle (θ) ranges from 60 degrees to 89 degrees relative to the axis of rotation of the coiled tubing reel. Element 35: wherein a cross-sectional surface area of the coiled tubing exit opening is at least three times a cross-sectional surface area of the coiled tubing string to allow the radially interior end of the coiled tubing string to exit the first flange at the reduced angle. Element 36: wherein a cross-sectional surface area of the coiled tubing exit opening is at least six times a cross-sectional surface area of the coiled tubing string to allow the radially interior end of the coiled tubing string to exit the first flange at the reduced angle. Element 37: wherein the first and second flanges are coupled to the drum proximate the first end and the second end, the first flange forming an exposed drum portion. Element 38: further including a coiled tubing clamping apparatus coupled to the exposed drum portion proximate the coiled tubing exit opening, the coiled tubing clamping apparatus configured to fix the radially interior end of the coiled tubing string to the coiled tubing reel. Element 39: further including a rigid coiled tubing connector having a first end and a second end, the first end of the rigid coiled tubing connector aligned with the coiled tubing clamping apparatus and the second end of the rigid coiled tubing connector extending through the exposed drum portion and into an interior of the drum. Element 40: further including connecting the coiled tubing string end to a coiled tubing connector. Element 41: wherein the first and second flanges are coupled to the drum proximate the first end and the second end, the first flange forming an exposed drum portion. Element 42: further including a coiled tubing clamping apparatus coupled to the exposed drum portion proximate the coiled tubing exit opening, the coiled tubing clamping apparatus configured to fix the radially interior end of the coiled tubing string to the coiled tubing reel. Element 43: further including clamping the radially interior end of the coiled tubing string fed through the coiled tubing exit opening to the coiled tubing clamping apparatus. Element 44: further including a rigid coiled tubing connector having a first end and a second end, the first end of the rigid coiled tubing connector aligned with the coiled tubing clamping apparatus and the second end of the rigid coiled tubing connector extending through the exposed drum portion and into an interior of the drum. Element 45: further including coupling the radially interior end of the coiled tubing string to the first end of the rigid coiled tubing connector. Element 46: wherein the coupling the radially interior end of the coiled tubing string to the first end of the rigid coiled tubing connector occurs prior to clamping the radially interior end of the coiled tubing string fed through the coiled tubing exit opening to the coiled tubing clamping apparatus. Element 47: wherein the coiled tubing exit opening extends through the sidewall thickness (t) at an angle (θ) that ranges from 30 degrees to 89 degrees relative to the axis of rotation. Element 48: wherein a cross-sectional surface area of the coiled tubing exit opening is at least three times a cross-sectional surface area of the coiled tubing string to allow the radially interior end of the coiled tubing to exit the first flange at the reduced angle. Element 49: further including connecting the coiled tubing string end to a coiled tubing connector located on the exterior side of the drum.

Those skilled in the art to which this application relates will appreciate that other and further additions, deletions, substitutions and modifications may be made to the described examples.

What is claimed is:

1. A coiled tubing reel, comprising:

a drum having a first end and a second end;

first and second flanges coupled to the drum, the first and second flanges configured to radially support a coiled tubing string wound upon the drum; and a coiled tubing exit opening extending through a sidewall thickness (t) of the first flange proximate a junction wherein the first flange couples to the drum, the coiled tubing exit opening configured to allow a radially interior end of the coiled tubing string to exit the first flange at a reduced angle, wherein the coiled tubing exit opening extends through the sidewall thickness (t) at an angle (θ) that is not parallel with nor perpendicular to an axis of rotation of the coiled tubing reel.

2. The coiled tubing reel as recited in claim 1, wherein the angle (θ) ranges from 30 degrees to 89 degrees relative to the axis of rotation of the coiled tubing reel.

3. The coiled tubing reel as recited in claim 1, wherein the angle (θ) ranges from 45 degrees to 89 degrees relative to the axis of rotation of the coiled tubing reel.

4. The coiled tubing reel as recited in claim 1, wherein the angle (θ) ranges from 60 degrees to 89 degrees relative to the axis of rotation of the coiled tubing reel.

5. The coiled tubing reel as recited in claim 1, wherein a cross-sectional surface area of the coiled tubing exit opening is at least three times a cross-sectional surface area of the coiled tubing string to allow the radially interior end of the coiled tubing string to exit the first flange at the reduced angle.

6. The coiled tubing reel as recited in claim 1, wherein a cross-sectional surface area of the coiled tubing exit opening is at least six times a cross-sectional surface area of the coiled tubing string to allow the radially interior end of the coiled tubing string to exit the first flange at the reduced angle.

7. The coiled tubing reel as recited in claim 1, wherein the first and second flanges are coupled to the drum proximate the first end and the second end, the first flange forming an exposed drum portion.

8. The coiled tubing reel as recited in claim 7, further including a coiled tubing clamping apparatus coupled to the exposed drum portion proximate the coiled tubing exit opening, the coiled tubing clamping apparatus configured to fix the radially interior end of the coiled tubing string to the coiled tubing reel.

9. The coiled tubing reel as recited in claim 8, further including a rigid coiled tubing connector having a first end and a second end, the first end of the rigid coiled tubing connector aligned with the coiled tubing clamping apparatus and the second end of the rigid coiled tubing connector extending through the exposed drum portion and into an interior of the drum.

10. A method for connecting an end of a coiled tubing string to a coiled tubing reel, comprising:

positioning the coiled tubing string end through an exit opening extending through a sidewall thickness (t) of a first reel flange proximate a junction wherein the first flange couples to a drum, wherein the coiled tubing exit opening extends through the sidewall thickness (t) at an angle (θ) that is not parallel with nor perpendicular to an axis of rotation of the coiled tubing reel, the coiled tubing exit opening configured to allow a radially interior end of the coiled tubing string to exit the first flange at a reduced angle; and clamping the end of the coiled tubing string to an exterior side of the reel drum.

11. The method as recited in claim 10, further including connecting the coiled tubing string end to a coiled tubing connector.

12. A method, comprising:

providing a coiled tubing reel, the coiled tubing reel including:

a drum having a first end and a second end;

first and second flanges coupled to the drum, the first and second flanges configured to axially and radially support a coiled tubing string wound upon the drum; and a coiled tubing exit opening extending through a sidewall thickness (t) of the first flange proximate a junction wherein the first flange couples to the drum, wherein the coiled tubing exit opening extends through the sidewall thickness (t) at an angle (θ) that is not parallel with nor perpendicular to an axis of rotation of the coiled tubing reel;

feeding a radially interior end of a coiled tubing string through the coiled tubing exit opening at a reduced angle (β); and rotating the coiled tubing reel with the radial interior end of the coiled tubing string fed through the coiled tubing exit opening about its axis of rotation to wind the coiling tubing string about the coiled tubing reel.

13. The method as recited in claim 12, wherein the first and second flanges are coupled to the drum proximate the first end and the second end, the first flange forming an exposed drum portion.

14. The method as recited in claim 13, further including a coiled tubing clamping apparatus coupled to the exposed drum portion proximate the coiled tubing exit opening, the coiled tubing clamping apparatus configured to fix the radially interior end of the coiled tubing string to the coiled tubing reel.

15. The method as recited in claim 14, further including clamping the radially interior end of the coiled tubing string fed through the coiled tubing exit opening to the coiled tubing clamping apparatus.

16. The method as recited in claim 15, further including a rigid coiled tubing connector having a first end and a second end, the first end of the rigid coiled tubing connector aligned with the coiled tubing clamping apparatus and the second end of the rigid coiled tubing connector extending through the exposed drum portion and into an interior of the drum.

17. The method as recited in claim 16, further including coupling the radially interior end of the coiled tubing string to the first end of the rigid coiled tubing connector.

18. The method as recited in claim 17, wherein the coupling the radially interior end of the coiled tubing string to the first end of the rigid coiled tubing connector occurs prior to clamping the radially interior end of the coiled tubing string fed through the coiled tubing exit opening to the coiled tubing clamping apparatus.

19. The method as recited in claim 12, wherein the coiled tubing exit opening extends through the sidewall thickness (t) at the angle (θ) that ranges from 30 degrees to 89 degrees relative to the axis of rotation.

20. The method as recited in claim 12, wherein a cross-sectional surface area of the coiled tubing exit opening is at least three times a cross-sectional surface area of the coiled tubing string to allow the radially interior end of the coiled tubing to exit the first flange at the reduced angle.

21. A method for connecting an end of a coiled tubing string to a coiled tubing reel, comprising:

positioning a radially interior end of a coiled tubing string through a coiled tubing exit opening extending through a sidewall thickness (t) of a first flange proximate a junction wherein the first flange couples to a drum, wherein the coiled tubing exit opening extends through the sidewall thickness (t) at an angle (θ) that is not parallel with nor perpendicular to an axis of rotation of the coiled tubing reel, the coiled tubing exit opening configured to allow the radially interior end of the coiled tubing string to exit the first flange at a reduced angle (β) relative to an axis of rotation of the drum; and clamping the radially interior end of the coiled tubing string that is extending out the first flange to an exterior side of the drum.

22. The method as recited in claim 21, further including connecting the coiled tubing string end to a coiled tubing connector located on the exterior side of the drum.

* * * * *